US011679335B2

(12) United States Patent
Mayer et al.

(10) Patent No.: US 11,679,335 B2
(45) **Date of Patent: *Jun. 20, 2023**

(54) HABITABLE SUPPORT STRUCTURE FOR OBSERVATION WHEELS

(71) Applicants: Haskel Mayer, Miami Beach, FL (US); Cyril Silberman, Miami Beach, FL (US)

(72) Inventors: Haskel Mayer, Miami Beach, FL (US); Cyril Silberman, Miami Beach, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/694,656

(22) Filed: Nov. 25, 2019

(65) Prior Publication Data

US 2020/0086222 A1 Mar. 19, 2020

Related U.S. Application Data

(63) Continuation of application No. 15/808,990, filed on Nov. 10, 2017, now Pat. No. 10,507,395, which is a (Continued)

(51) Int. Cl.
*A63G 27/00* (2006.01)
*E04H 1/06* (2006.01)
(Continued)

(52) U.S. Cl.
CPC ..... *A63G 27/00* (2013.01); *A63G 27/02* (2013.01); *E04H 1/04* (2013.01); *E04H 1/06* (2013.01); *E04H 3/02* (2013.01); *E04H 6/08* (2013.01)

(58) Field of Classification Search
CPC ..... A63G 27/00; A63G 27/02; A63G 27/06; F16C 19/52; F16C 39/02; F16C 2300/14;
(Continued)

(56) References Cited

U.S. PATENT DOCUMENTS 1,050,567 A * 1/1913 Saunders ..... A63G 27/00 472/45
1,861,597 A * 6/1932 Gehm ..... A63G 27/00 472/30
(Continued)

FOREIGN PATENT DOCUMENTS

CN 1773134 5/2006
CN 1952419 4/2007
(Continued)

OTHER PUBLICATIONS

"London Eye" (YouTube video published Jul. 22, 2012 by London Landmarks at https://www.youtube.com/watch?v=pkSUuBugQOo) (Year: 2012).*
(Continued)

*Primary Examiner* — Michael D Dennis
(74) *Attorney, Agent, or Firm* — Norton Rose Fulbright US LLP

(57) ABSTRACT

Systems and related methods related to structures with large-scale rotatable elements. Some of the present systems comprise: a tower defining a plurality of human-habitable spaces; a tower hub coupled to the tower and having a transverse dimension of at least 50 feet; an observation wheel rotatably coupled to the tower and having a central wheel hub; and one or more bearings disposed between the tower hub and the wheel hub to rotatably support the observation wheel relative to the tower.

20 Claims, 23 Drawing Sheets

Related U.S. Application Data continuation of application No. 14/795,517, filed on Jul. 9, 2015, now Pat. No. 9,821,235.

(60) Provisional application No. 62/022,624, filed on Jul. 9, 2014.

(51) Int. Cl.

| | |
|---|---|
| ***E04H 3/02*** | (2006.01) |
| ***E04H 1/04*** | (2006.01) |
| ***E04H 6/08*** | (2006.01) |
| ***A63G 27/02*** | (2006.01) |

(58) Field of Classification Search

CPC ..... F16C 2316/00; E04H 1/06; E04H 3/02; E04H 1/04; E04H 6/08

USPC .... 472/45, 44, 3, 32, 29, 27, 39, 43, 46, 47, 472/136; 104/53, 124

See application file for complete search history.

(56) References Cited

U.S. PATENT DOCUMENTS

| | | | | | |
|---|---|---|---|---|---|
| 1,987,004 | A | * | 1/1935 | Eyerly | A63G 27/00 472/44 |
| 2,101,274 | A | * | 12/1937 | Stanzel | A63G 27/02 472/30 |
| 2,397,857 | A | * | 4/1946 | Hall | A63G 27/04 472/30 |
| 2,934,341 | A | * | 4/1960 | Shepherd | A63G 27/02 472/44 |
| 3,226,113 | A | | 12/1965 | Mercer et al. | |
| 4,007,926 | A | * | 2/1977 | Ottaway | A63G 4/00 472/29 |
| 4,410,173 | A | * | 10/1983 | Bohme | A63G 9/08 472/44 |
| 4,920,275 | A | | 4/1990 | Itoh | |
| 4,988,089 | A | | 1/1991 | Knijpstra | |
| 5,161,104 | A | | 11/1992 | Fox et al. | |
| 6,128,863 | A | | 10/2000 | Millay | |
| 6,328,658 | B1 | * | 12/2001 | Gnezdilov | A63G 27/00 472/136 |
| 8,216,077 | B2 | | 7/2012 | Bussink et al. | |
| 8,641,541 | B2 | | 2/2014 | Kitchen | |
| D733,826 | S | * | 7/2015 | Fabbri | D21/830 |
| 2002/0042303 | A1 | | 4/2002 | Larson | |
| 2009/0075740 | A1 | | 3/2009 | Kojro | |
| 2010/0004067 | A1 | | 1/2010 | Chu | |
| 2010/0009767 | A1 | * | 1/2010 | Crawford | A63G 31/007 472/13 |
| 2012/0163745 | A1 | * | 6/2012 | Maeda | F16C 41/008 384/477 |
| 2013/0095936 | A1 | | 4/2013 | Gnezdilov | |

FOREIGN PATENT DOCUMENTS

| | | | | |
|---|---|---|---|---|
| CN | 102124236 | | 7/2011 | |
| CN | 103736276 | | 4/2014 | |
| JP | 2003003681 | * | 1/2003 | A63G 27/00 |
| JP | 2009254577 | | 11/2009 | |
| WO | WO2007/0145506 | * | 12/2007 | A63G 27/00 |
| WO | WO 2007/145506 | | 12/2007 | |

OTHER PUBLICATIONS

International PCT Search Report and Written Opinion issued in PCT/US2015/039740 dated Oct. 5, 2015.

Illia, T Las Vegas Observation Wheel Record Heights. May 13, 2013 [Retrieved on Sep. 11, 2015]. Retrieved from the Internet: <http://southwest.construction.com/southwest_construction_projects/2013/0520-las-vegas-observation-wheel-reaches-record-heights.asp>. Entire document.

SKF Group. SKF Explorer spherical roller bearings. Mar. 3, 2014. [Retrieved on Sep. 11, 2015]. Retrieved from the internet: <https://www.youtube.com/watch?v=2cPMpWjnQok>. entire video.

Supplementary European Search Report issued in corresponding European Application No. 15818564.5, dated Feb. 13, 2018.

Office Action issued in counterpart Chinese Patent Application No. 201580042780.9, dated Aug. 14, 2018. (English Translation).

Office Action issued in Corresponding Chinese Application No. 202010181438.X, dated Apr. 25, 2021 (English Translation).

Examination Report issued in Corresponding United Arab Emirates Application No. P6000016/2017, dated Jan. 31, 2021.

Search Report issued in Corresponding United Arab Emirates Application No. P6000016/2017, dated Jan. 31, 2021.

Office Action Issued in Corresponding European Patent Application No. 15818564.5, dated Apr. 20, 2021.

* cited by examiner

HABITABLE SUPPORT STRUCTURE FOR OBSERVATION WHEELS

CROSS-REFERENCE TO RELATED APPLICATIONS

This application is a continuation of U.S. application Ser. No. 15/808,990, filed Nov. 10, 2017, which is a continuation of U.S. application Ser. No. 14/795,517, filed Jul. 9, 2015, which claims priority to U.S. Provisional Patent Application No. 62/022,624, filed Jul. 9, 2014, each of which are incorporated by reference in their entirety.

U.S. application Ser. No. 14/191,071, filed Feb. 26, 2014 claims priority to U.S. Provisional Patent Application No. 61/769,359, filed Feb. 26, 2013, both of which are incorporated by reference in their entireties.

FIELD OF INVENTION

The present invention is generally related to large structures such as observation wheels and more particularly, but not by way of limitation, to a rolling-element bearing system and/or other features and improvements for large structures such as observation wheels.

BACKGROUND

Observation wheels such as the London Eye and subsequent wheels, such as the Singapore Flyer and the Star of Nanchang, contain two giant rolling element bearings in the center hub of the wheel. These giant bearings require a giant seal to encompass the bearing in order to hold in lubricant. When utilizing giant bearings in an observation wheel, the fact that components can only be produced to a certain size becomes a constraint on the overall size of the attraction. The engineering considerations that are present in the design of such large systems are materially different than those that exist with respect to smaller systems.

SUMMARY

At least some of the present embodiments provide and/or include an improved bearing system for a large system such as an observation wheel that reduces and/or eliminates the size constraints that are generally associated with larger conventional bearings.

Some embodiments of the present systems comprise: a tower; a tower hub coupled to the tower and having a transverse dimension of at least 50 feet; an observation wheel rotatably coupled to the tower and having a central wheel hub; a plurality of roller bearings disposed between the tower hub and the wheel hub to rotatably support the observation wheel relative to the tower, the roller bearings each having a diameter that is less than one quarter of the transverse dimension of the wheel hub. In some embodiments, the tower includes a base and a height of at least 200 feet above a ground level at the base, and the observation wheel having a transverse dimension of at least 400 feet. In some embodiments, the tower is a first tower, and the system further comprises: a second tower spaced apart from the first tower and coupled to the tower hub; where the tower hub extends between the first and second towers. Some embodiments further comprise: a plurality of bearing mounts each coupled to a different one of the roller bearings. In some embodiments, the plurality of bearing mounts each has a first end coupled in fixed relation to the tower hub and a second end rotatably coupled to the respective roller bearing. In some embodiments, the wheel hub has a first diameter, the tower hub has a second diameter that is smaller than the first diameter, and the wheel hub is configured to rotate around the tower hub. In some embodiments, each of the plurality of roller bearings has a diameter of between 0.5 and 5 feet. In some embodiments, the diameter of the tower hub differs from the diameter of the wheel hub by 4 feet or more. In some embodiments, the diameter of the tower hub is greater than 70 feet. In some embodiments, each of the plurality of roller bearings is independently sealed. Some embodiments comprise a loading structure coupled to the tower such that portions of the loading wheel are accessible from the loading structure. In some embodiments, a portion of the loading structure is cantilevered.

Some embodiments of the present methods comprise: disposing a plurality of bearings between a tower hub and an observation wheel rotatably coupled to the tower, the tower hub coupled to a tower and having a transverse dimension of at least 50 feet, and the observation wheel having a central wheel hub; where the roller bearings are disposed between the tower hub and the wheel hub to rotatably support the observation wheel relative to the tower, the roller bearings each having a diameter that is less than one quarter of the transverse dimension of the wheel hub. In some embodiments, the tower includes a base and a height of at least 200 feet above a ground level at the base, and the observation wheel having a transverse dimension of at least 400 feet. In some embodiments, the tower is a first tower, a second tower is spaced apart from the first tower and coupled to the tower hub, and the tower hub extends between the first and second towers. In some embodiments, a plurality of bearing mounts are each coupled to a different one of the roller bearings. In some embodiments, the plurality of bearing mounts each has a first end and a second end rotatably coupled to the respective roller bearing, and disposing the roller bearings comprises coupling the first end of each roller bearing in fixed relation to the tower hub. In some embodiments, the wheel hub has a first diameter, the tower hub has a second diameter that is smaller than the first diameter, and the wheel hub is configured to rotate around the tower hub. In some embodiments, each of the plurality of bearing elements has a diameter of between 0.5 and 5 feet. In some embodiments, the diameter of the tower hub differs from the diameter of the wheel hub by 4 feet or more. In some embodiments, the diameter of the tower hub is greater than 70 feet. In some embodiments, each of the plurality of roller bearings is independently sealed.

Some embodiments of the present systems comprise: a tower defining a plurality of human-habitable spaces; a tower hub coupled to the tower and having a transverse dimension of at least 50 feet; an observation wheel rotatably coupled to the tower and having a central wheel hub; and one or more bearings disposed between the tower hub and the wheel hub to rotatably support the observation wheel relative to the tower. In some embodiments, the tower is a first tower, and the system further comprises: a second tower spaced apart from the first tower and coupled to the tower hub; where the tower hub extends between the first and second towers. In some embodiments, the second tower defines a plurality of human-habitable spaces. In some embodiments, each tower includes a base and a height of at least 200 feet above a ground level at the base, and the observation wheel has a transverse dimension of at least 400 feet.

In some embodiments of the present systems in which one or more towers each defines human-habitable spaces, each tower comprises: a suspension member supporting at least one of the one or more bearings; and an enclosure supporting the tower hub; where the enclosure is coupled to the suspension member such that the stiffness of the tower is greater than that of the suspension member alone. In some embodiments, the at least one bearing comprises at least one roller bearing. In some embodiments, the at least one bearing comprises: a plurality of roller bearings disposed between the tower hub and the wheel hub to rotatably support the observation wheel relative to the tower, the roller bearings each having a diameter that is less than one quarter of the transverse dimension of the wheel hub. Some embodiments further comprise: a plurality of bearing mounts each coupled to a different one of the roller bearings. In some embodiments, e the plurality of bearing mounts each has a first end coupled in fixed relation to one of the suspension member(s) and a second end rotatably coupled to the respective roller bearing. In some embodiments, the wheel hub has a first diameter, the tower hub has a second diameter that is smaller than the first diameter, and the wheel hub is configured to rotate around the tower hub. In some embodiments, each of the plurality of roller bearings has a diameter of between 0.5 and 5 feet. In some embodiments, the diameter of the tower hub differs from the diameter of the wheel hub by 4 feet or more. In some embodiments, the diameter of the tower hub is greater than 70 feet. In some embodiments, each of the plurality of roller bearings is independently sealed. In some embodiments, the human-habitable space defined in each tower includes at least thirty percent (e.g., at least fifty percent) of the volume of the tower above ground level at a base of the tower.

Some embodiments of the present systems comprise: erecting a tower defining a plurality of human-habitable spaces; and coupling a tower hub to the tower and having a transverse dimension of at least 50 feet; where the tower and/or tower hub are configured to support an observation wheel having a central wheel hub and rotatable coupled to the tower via one or more bearings disposed between the tower hub and the wheel hub. In some embodiments, the system comprises an embodiment of the present systems.

The term "coupled" is defined as connected, although not necessarily directly, and not necessarily mechanically; two items that are "coupled" may be unitary with each other. The terms "a" and "an" are defined as one or more unless this disclosure explicitly requires otherwise. The term "substantially" is defined as largely but not necessarily wholly what is specified (and includes what is specified; e.g., substantially 90 degrees includes 90 degrees and substantially parallel includes parallel), as understood by a person of ordinary skill in the art. In any disclosed embodiment, the terms "substantially," "approximately," and "about" may be substituted with "within [a percentage] of" what is specified, where the percentage includes 0.1, 1, 5, and 10 percent.

Further, a device or system that is configured in a certain way is configured in at least that way, but it can also be configured in other ways than those specifically described.

The terms "comprise" (and any form of comprise, such as "comprises" and "comprising"), "have" (and any form of have, such as "has" and "having"), "include" (and any form of include, such as "includes" and "including"), and "contain" (and any form of contain, such as "contains" and "containing") are open-ended linking verbs. As a result, an apparatus that "comprises," "has," "includes," or "contains" one or more elements possesses those one or more elements, but is not limited to possessing only those elements. Likewise, a method that "comprises," "has," "includes," or "contains" one or more steps possesses those one or more steps, but is not limited to possessing only those one or more steps.

Any embodiment of any of the apparatuses, systems, and methods can consist of or consist essentially of—rather than comprise/include/contain/have—any of the described steps, elements, and/or features. Thus, in any of the claims, the term "consisting of" or "consisting essentially of" can be substituted for any of the open-ended linking verbs recited above, in order to change the scope of a given claim from what it would otherwise be using the open-ended linking verb.

The feature or features of one embodiment may be applied to other embodiments, even though not described or illustrated, unless expressly prohibited by this disclosure or the nature of the embodiments.

Some details associated with the embodiments described above and others are described below.

BRIEF DESCRIPTION OF THE DRAWINGS

The following drawings illustrate by way of example and not limitation. For the sake of brevity and clarity, every feature of a given structure is not always labeled in every figure in which that structure appears. Identical reference numbers do not necessarily indicate an identical structure. Rather, the same reference number may be used to indicate a similar feature or a feature with similar functionality, as may non-identical reference numbers. The figures are drawn to scale (unless otherwise noted) for at least the embodiments shown.

DETAILED DESCRIPTION OF ILLUSTRATIVE EMBODIMENTS

Figure 1:
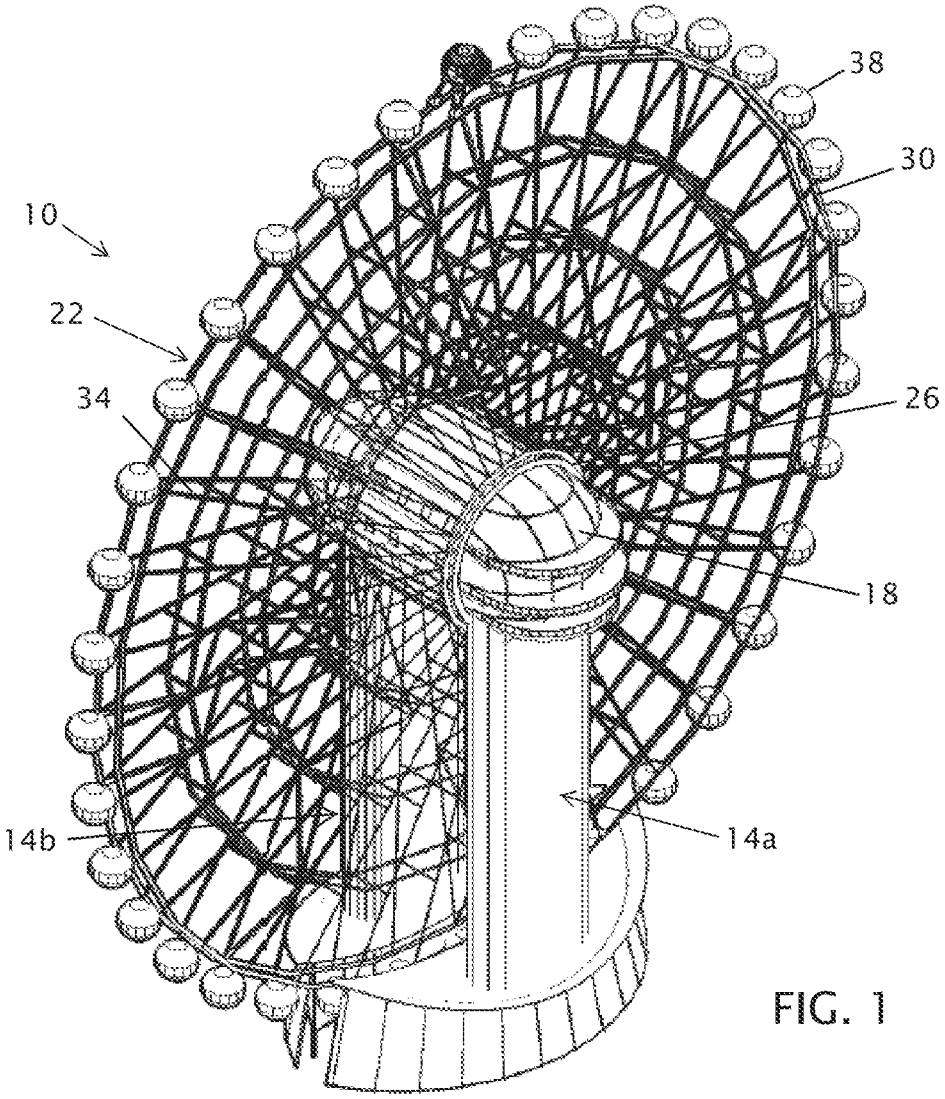
FIG. 1 is a perspective view of one of the present systems.
Figure 2:
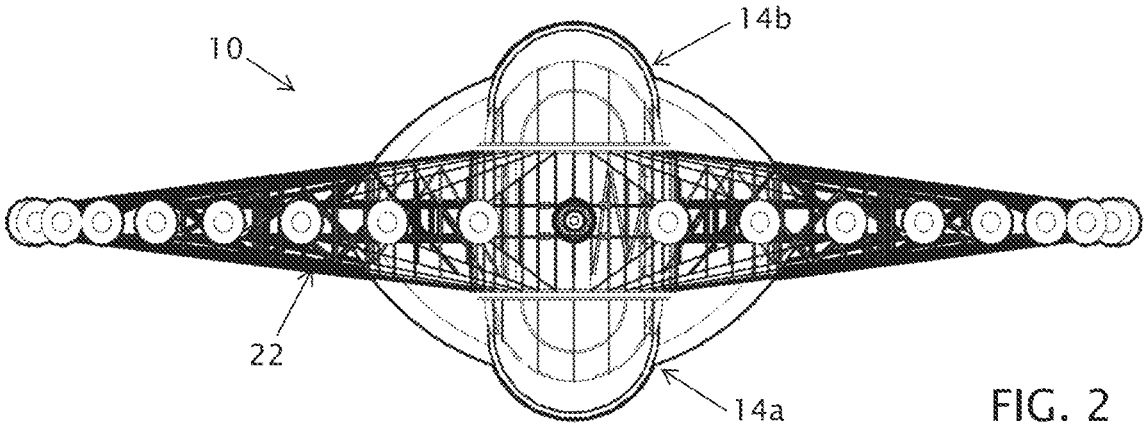
FIG. 2 is a top view of the system of FIG. 1.
Figure 3:
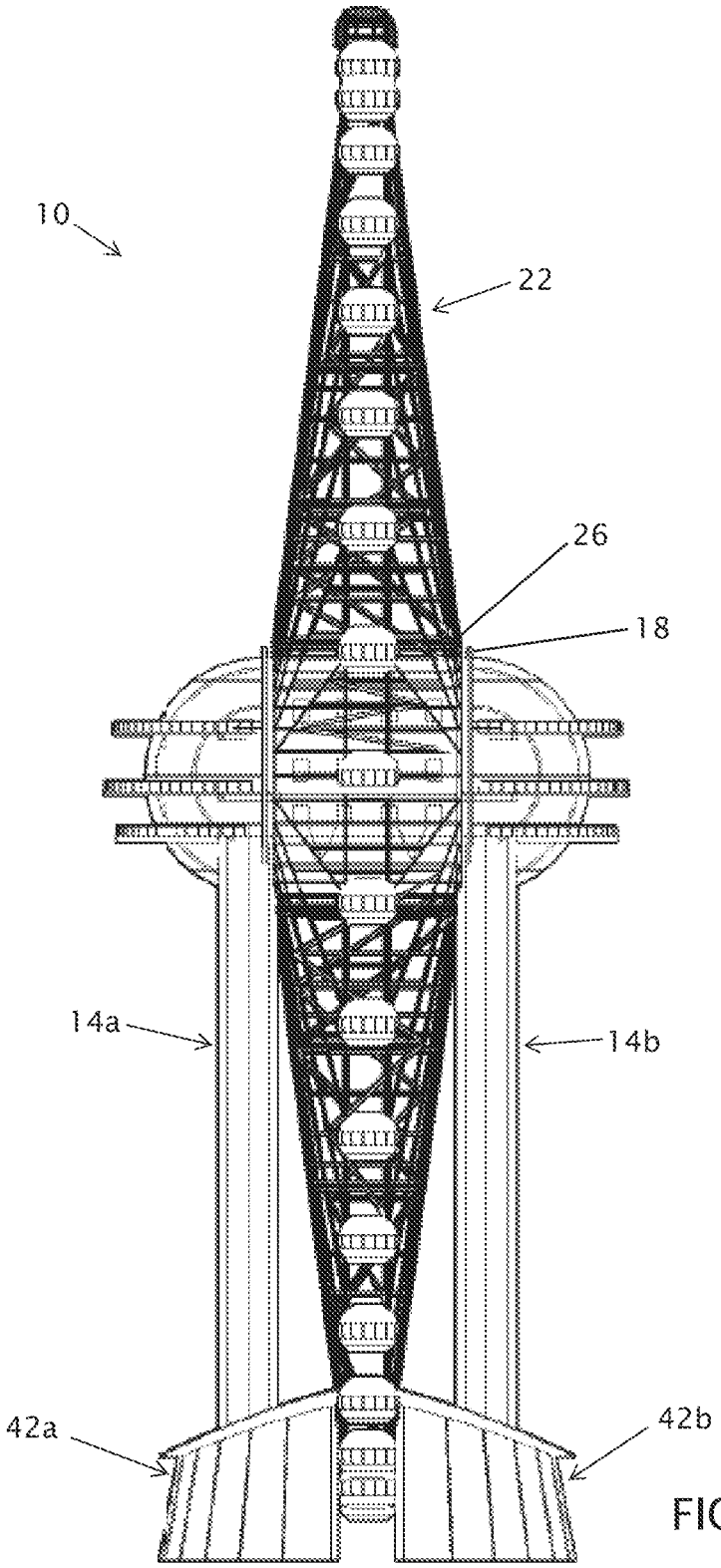
FIG. 3 is an front view of the system of FIG. 1.
Figure 4:
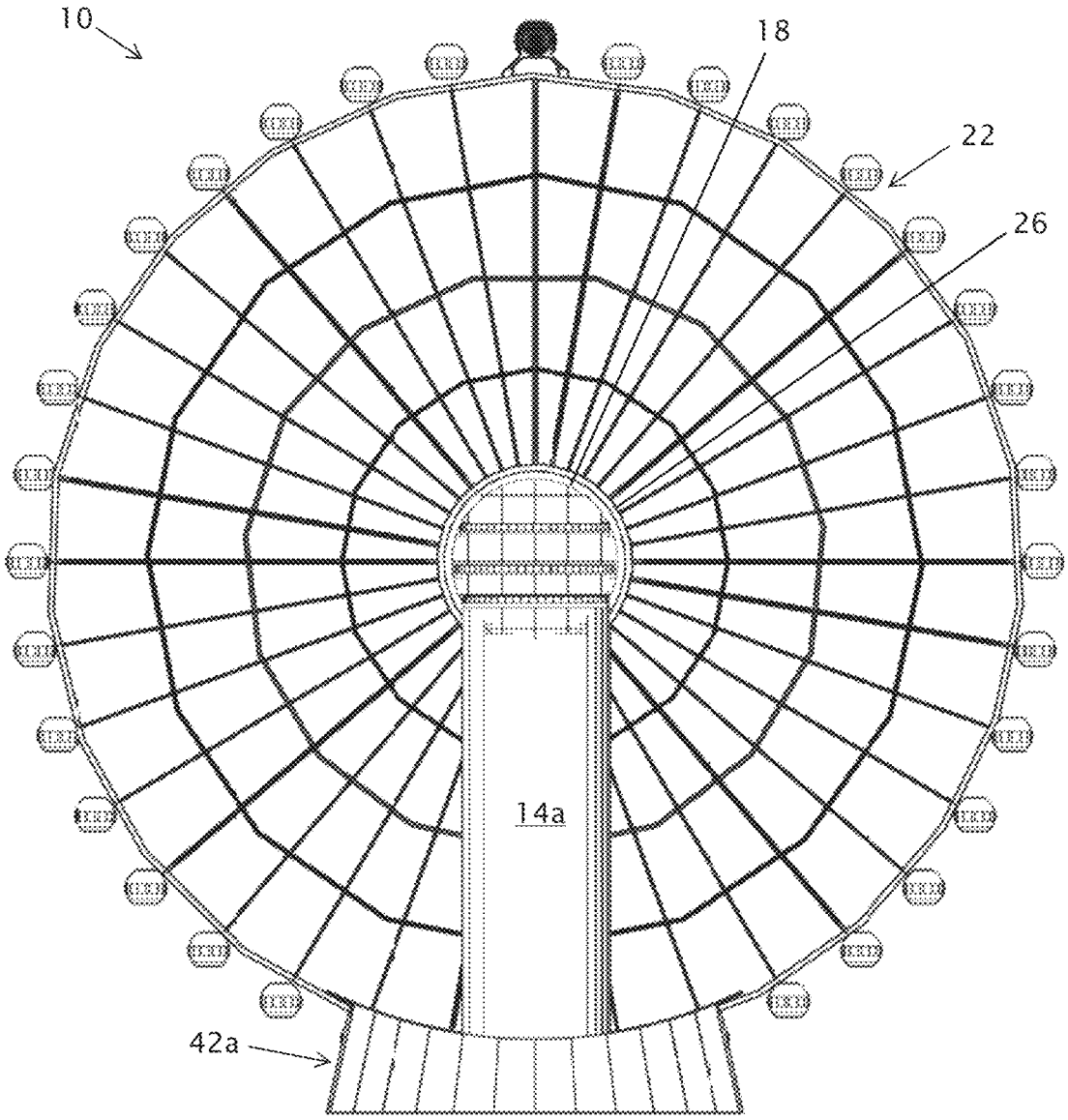
FIG. 4 is a side view of the system of FIG. 1.

Referring now to the drawings, and more particular to FIGS. 1-4, shown there and designated by the reference numeral 10 is one example of the present systems. In the embodiment shown, system 10 is an observation wheel system. In the embodiment shown, system 10 comprises a first tower 14*a* and a second tower 14*b*, a tower hub 18 coupled to and extending between first and second towers 14*a* and 14*b*. Tower hub 18 can, in some embodiments, have a transverse dimension of at least 50 feet (e.g., greater than 70 feet). For example, in the embodiment shown, tower hub 18 has a diameter of 80 feet. In the embodiment shown, system 10 also comprises an observation wheel 22 rotatably coupled to the towers and having a central wheel hub 26. In the embodiment shown, observation wheel 22 comprises an outer ring 30 coupled to wheel hub 26 by a plurality of struts or spokes (and/or cables) 34, and a plurality of gondolas 38 coupled to ring 30. In the embodiment shown, ring 30 comprises dual ring members spaced apart and coupled together by a plurality of lateral members. Similarly, in the embodiment shown, wheel hub 26 comprises dual circular rail members (e.g., each having an I-shaped cross-sectional shape) that are spaced apart as illustrated. In the some embodiments, each of towers 14*a* and 14*b* has a base 42*a* and 42*b*, respectively, and a height of at least 200 feet above a ground level at each base, and observation wheel 22 has a transverse dimension of at least 400 feet (e.g., a diameter of 500 feet). In other embodiments, one of towers 14*a* and 14*b* may be omitted such that tower hub 18 is cantilevered from a single tower. Towers 14*a* and 14*b* and/or tower hub 18 can, for example, comprise concrete and/or steel, and observation wheel 22 can comprise steel and/or any of various other high-strength metallic alloys.

Figure 5:
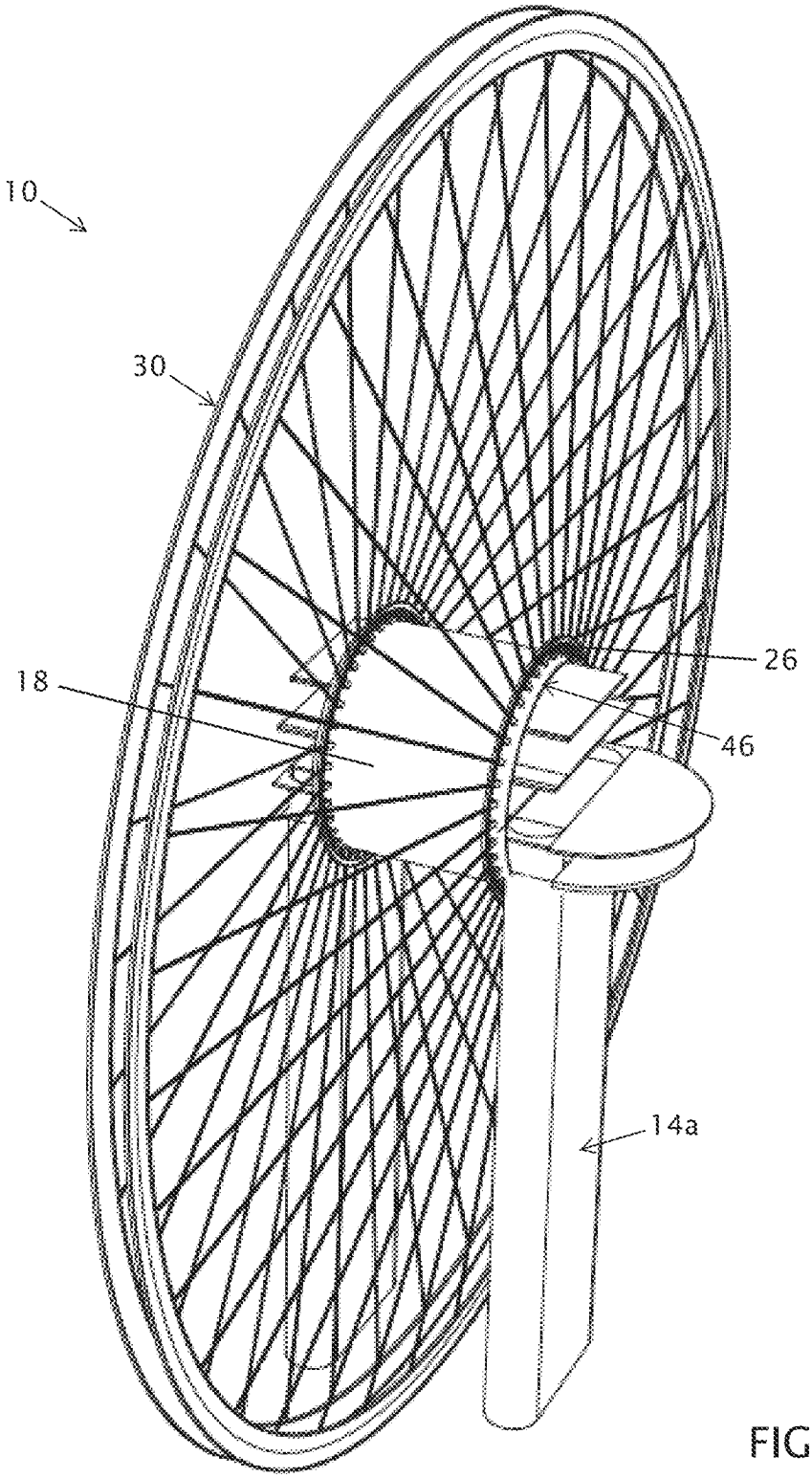
FIG. 5 is a perspective view of a portion of the system of FIG. 1.
Figure 6:
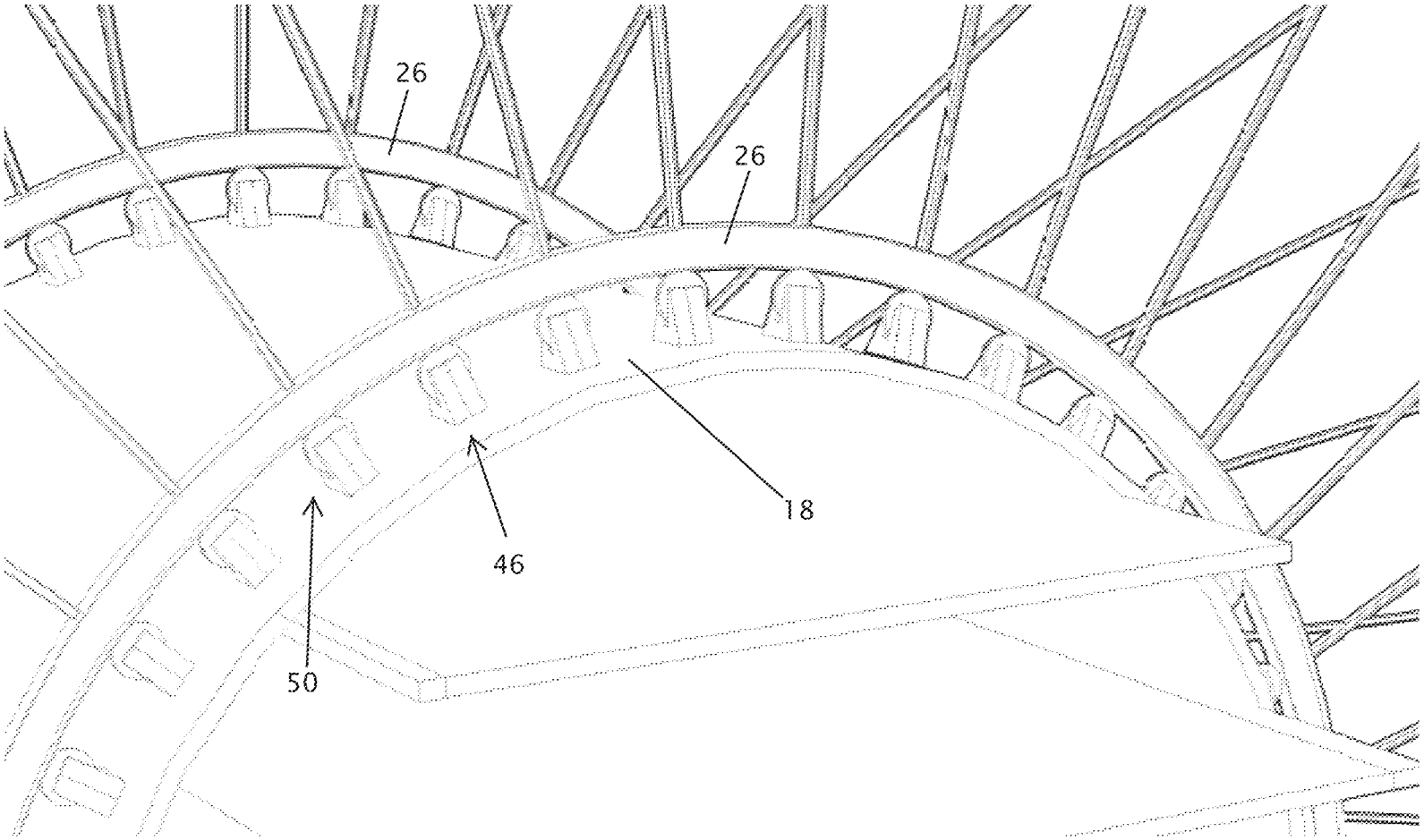
FIG. 6 is a fragmentary perspective view of a bearing subsystem of the system shown in FIG. 1.
Figure 7A:
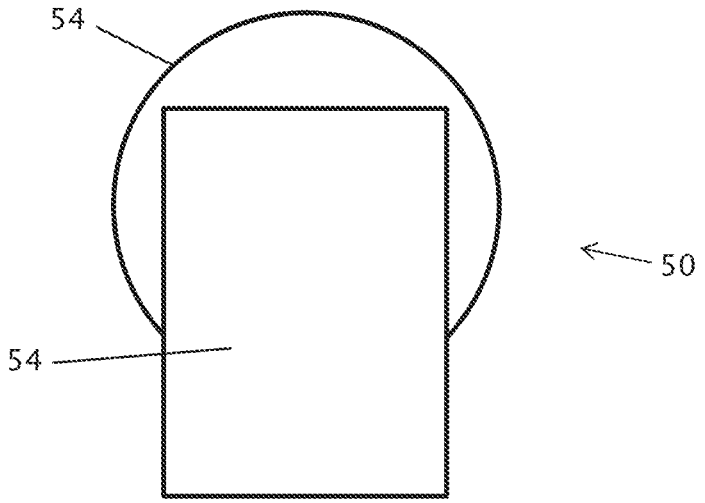
FIGS. 7A and 7B are side and front views, respectively, of a roller bearing assembly of the bearing subsystem shown in FIG. 6.
Figure 7B:
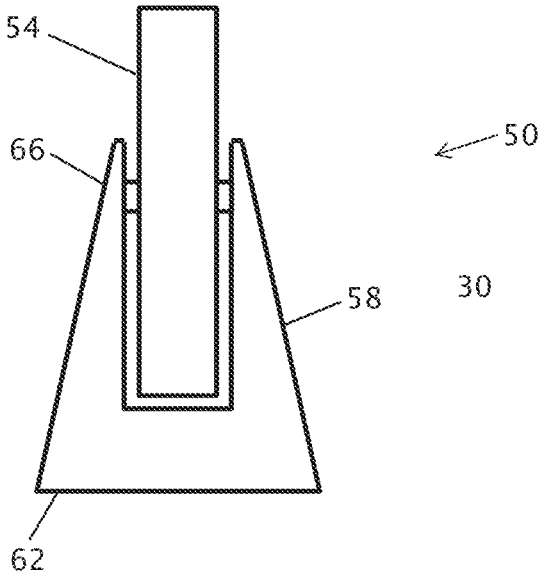

Referring now to FIGS. 5-7B; FIGS. 5 and 6 depict fragmentary views of system 10 showing tower hub 18, wheel hub 26, and a bearing subsystem 46 between the tower hub and the wheel hub in more detail; and FIGS. 7A-7B depict a bearing assembly 50 of the bearing subsystem. In this embodiment, bearing system 46 includes a plurality of roller bearings 54 disposed between tower hub 18 and wheel hub 26 to rotatably support observation wheel 22 relative to the tower (and tower hub 26), the roller bearings each having a transverse dimension (e.g. diameter) that is less than one quarter of the transverse dimension of the wheel hub. In the embodiment shown, each bearing assembly 50 includes a roller bearing 54 and a bearing mount 58. More particularly, in this embodiment, each bearing mount 58 has a first end 62 coupled in fixed relation to tower hub 18 and a second end 66 rotatably coupled to the roller bearing 54 (e.g., via an axle or pair of stub axles, as illustrated in FIG. 7B). In this embodiment, roller bearing 54 has a diameter of between 0.5 and 5 feet (e.g., 4 feet). In the embodiment shown, each bearing assembly 50 can be independently sealed. For example, where roller bearing 54 is coupled to bearing mount 58 by a single axle that extends through the roller bearing, grease can be disposed between the roller bearing and the axle and can be retained by seals coupled to the roller bearing on opposite sides of the roller bearing. As another example, where the roller bearing is coupled to the bearing mount by stub axles on either side of the roller bearing, grease can be disposed between the stub axles and the bearing mount and retained by seals coupled to the bearing mount on opposite sides of the roller bearing. In other embodiment, some or all of bearing mounts 58 may be affixed to the wheel hub. Roller bearings 54 and/or bearing mounts 58 can comprise, for example, steel and/or any of various other high-strength metallic alloys. Roller mounts 58 can also, in some embodiments, comprise concrete. Each individual roller bearing 54 may be covered with an elastomeric layer (or "spring pad"), which may be configured to function as an independent suspension for each roller bearing.

In some embodiments, an external diameter of the tower hub differs from an external diameter of the wheel hub by 4 feet or more. For example, in the embodiment shown, the inner diameter of wheel hub 26 is about 10 feet greater than the outer diameter of the portion of tower hub 18 around which wheel hub 26 is configured to rotate. In this example, the radial gap between the tower hub and the wheel hub at any given point is therefore 5 feet, such that the overall height of each bearing assembly 50 is 5 feet.

The present embodiments also offer additional benefits relative to conventional large-scale observation wheel attractions, which are typically limited in the external wind forces they can withstand during a storm or other wind event. The London Eye and subsequent wheels, such as the Singapore Flyer and the Star of Nanchang, for example, contain two, large, self-contained, sealed-axle rolling element bearings in the center hub of the wheel, which require a giant seal to encompass the bearing in order to exclude contamination and hold in lubricant. When utilizing large bearings in an observation wheel, the fact that high-grade metallurgical components can only be produced to a certain size while still maintaining quality becomes a constraint on the overall size of the attraction in high-wind cities. The present embodiments with a plurality of smaller, independently sealed bearing elements allow for the operation of extremely large pieces while negating the need for a large bearing and a large seal to encompass that bearing. For example, the embodiment of system 10 depicted in FIGS. 1-4, includes approximately 80 smaller, independently sealed bearing assemblies 50, reducing and/or eliminating many if not all of the size constraints typically associated with larger bearings. The relatively larger tower hub 18, in combination with the plurality of smaller bearings, makes construction of larger-scale observation wheels technically feasible by improving the manufacturability and durability of the bearing components, as well as improving the wind-loads that the system is able to ensure. For example, in system 10 the outer diameter of tower hub 18 of 80 feet aids in distributing high wind loads and results in a structurally beneficial ratio of the dimensions of the tower hub (and of the wheel hub) relative to the length of the spokes of the wheel.

Figure 8A:
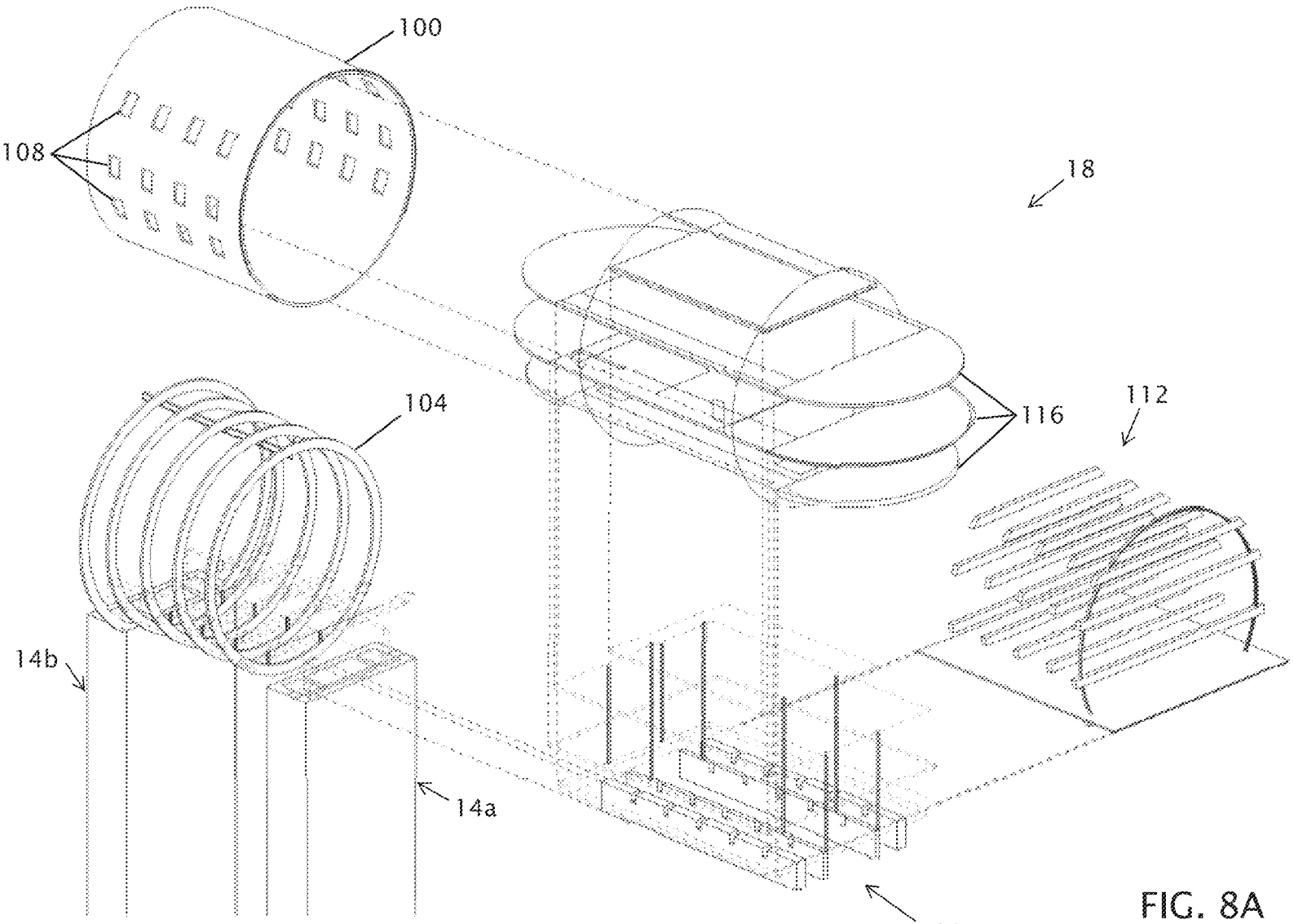
FIG. 8A is an exploded perspective view of part of a tower hub portion of the system of FIG. 1.
Figure 8B:
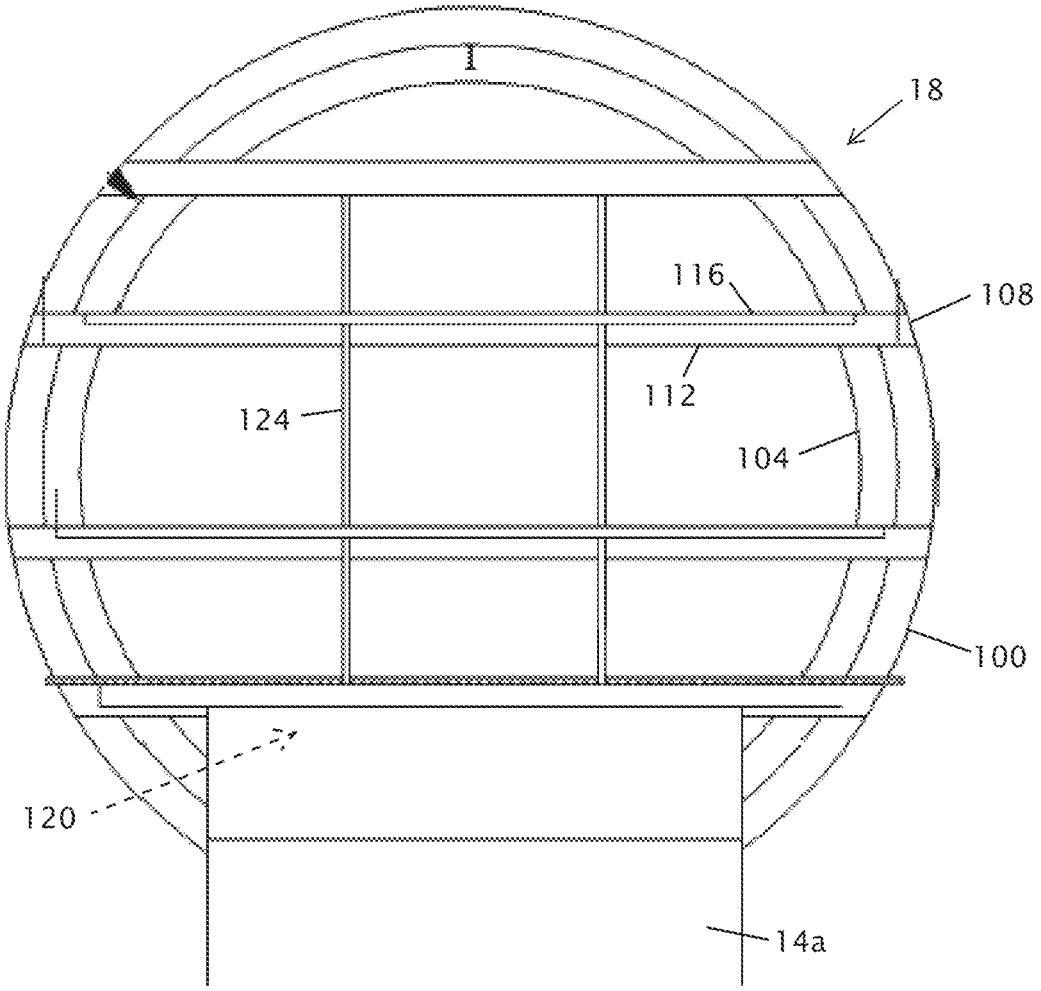
FIG. 8B is a side view of the part of the tower hub portion shown in FIG. 7A.

As illustrated in FIGS. 8A and 8B, in the depicted embodiment of system 10, the large-diameter (80 feet) of tower hub 18 also provides up to 20,000 square feet or more of unique event space within the tower hub—a feature not available due to the bearing design in conventional observation wheels. In this embodiment, tower hub 18 includes a cylindrical steel outer shell 100 supported by a plurality of circular steel girders 104 disposed within shell 100. In this embodiment, shell 100 includes a plurality of openings 108 through which beams 112 (e.g., steel and/or pre-stressed concrete beams) can extend to support (e.g., concrete) floors 116, as shown. In this embodiment, tower hub 18 further includes and is supported by beams 120 that extend between towers 14*a* and 14*b*, and through shell 100. A plurality of vertical columns 124 can further support the structural integrity of tower hub 18 which functions as an inner compression ring that is compressed by forces imparted on the roller bearings by the inner surfaces of wheel hub 26, which acts as an outer race beam. In some embodiments, the resulting space within the tower hub can include several levels of observation decks with interior and exterior space for visitors separated by glass windows. In other embodiments, shell 100 can comprise concrete.

Of course, system 10 also includes a robust (e.g., concrete) foundation (not shown), especially where installed in areas with high winds (e.g., Miami, where it would be subject to hurricane-force wind loads). The foundation may, for example, include drilled foundation piers extending below the ground surface. Towers 14*a* and 14*b* cooperate with the foundation to control and absorb high wind loads. These towers also provide access to the tower hub with stairways (e.g., extending up through the center of one or both towers) and/or elevators (e.g., extending up along a peripheral portion of the tower). The towers may, for example, be constructed or built by way of slip-formed concrete and can be configured, as shown, to provide a relatively narrow base (relative to the diameter of the observation wheel) which may be valuable in a congested city environment.

In some embodiments, a unique quadrant truss arrangement may be used in constructing and erecting observation wheel 22 that is more efficient than methods utilized on past observation wheel structures. In particular, spokes 34 can be erected and coupled to wheel hub 26 one spoke at a time with the respective spoke hanging down between the towers (14*a* and 14*b*) and then the spoke can be jacked or pulled up as the wheel hub is rotated a subsequent spoke is erected and coupled to the wheel hub, thereby reducing the need for full height cranes (e.g., cranes that are as tall as the full observation wheel.

In the embodiment shown, observation wheel 22 is configured to be operated (rotated) with a traction wheel drive system, located between tower hub 18 and wheel hub 26 (e.g., in place of or between two hub assemblies 50). One or more motor-driven wheels (e.g., steel or urethane-covered wheels) can be coupled to a motor that is fixed to either of the tower hub or wheel hub and driven in contact the other of the tower hub or wheel hub. For example, it will generally be more efficient to fix the motor relative to the tower hub so the mass of the motor need not be driven along with the rest of the observation wheel. These driven wheels may, for example, be driven by electric motors coupled to gear reducers that drive a main gear attached to the wheel.

In some embodiments, system 10 also includes a secondary drive system (e.g., within one or both of bases 42*a* and 42*b*) that can apply rotational force to the observation wheel at the wheel's outer ring 30) using similar steel and/or urethane-covered traction wheels driven by gear-head electric motors. Such a secondary drive system can also provide an emergence egress system for rotating observation wheel 22 to evacuate riders in case the primary drive system fails.

In some embodiments, system 10 can include a plurality of solar cells disposed on towers 14*a* and 14*b*, bases 42*a* and 42*b*, and/or observation wheel 22. In some embodiments, such solar cells (and corresponding storage batteries, if included) can provide a majority (if not all) of the energy needed to rotate the observation wheel (e.g., at least during times of balanced or substantially steady-state operation—at which the rolling friction is relatively minimal due to improved bearing system 46).

Figure 9A:
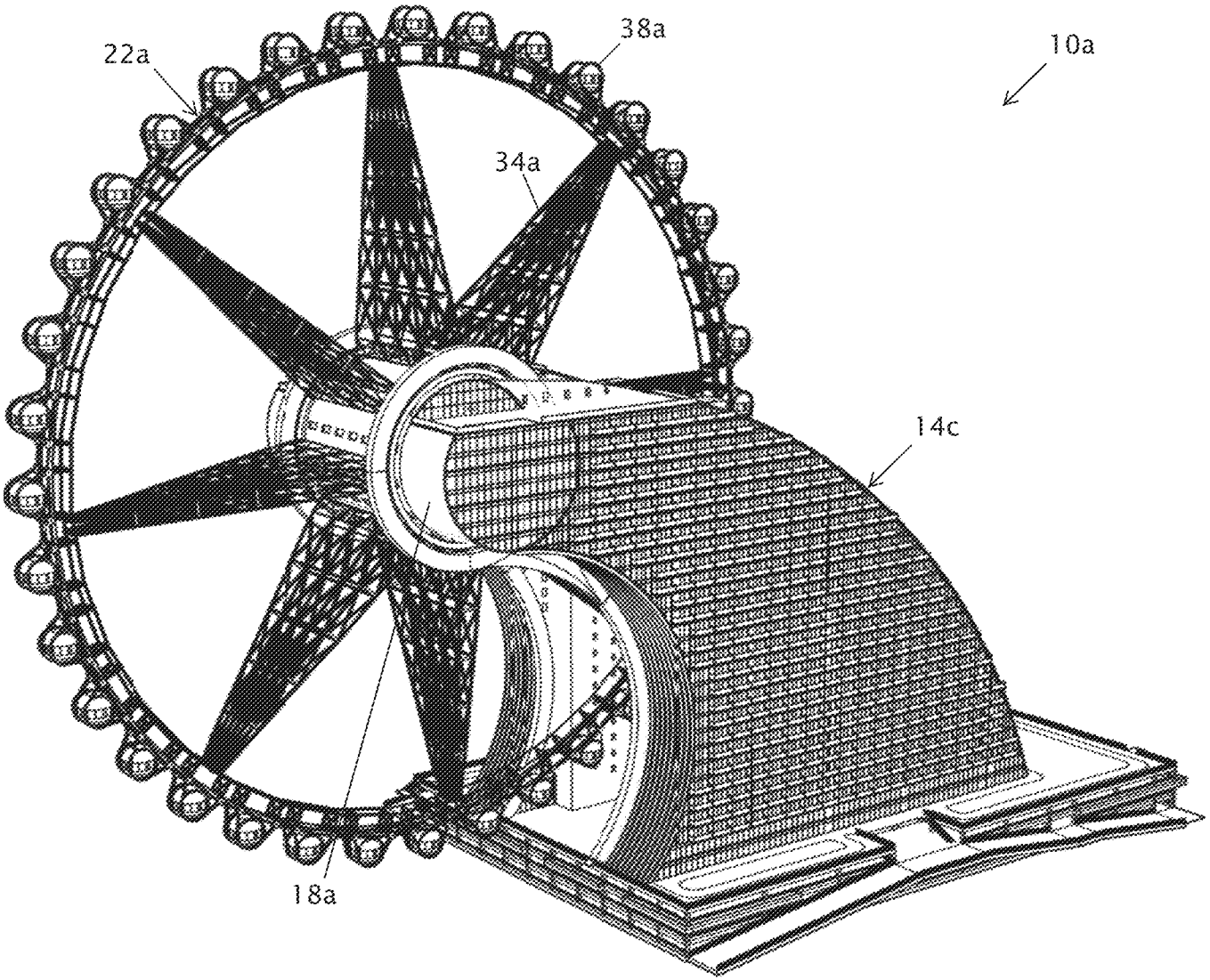
FIG. 9A is perspective view of a second embodiment of the present systems.
Figure 9B:
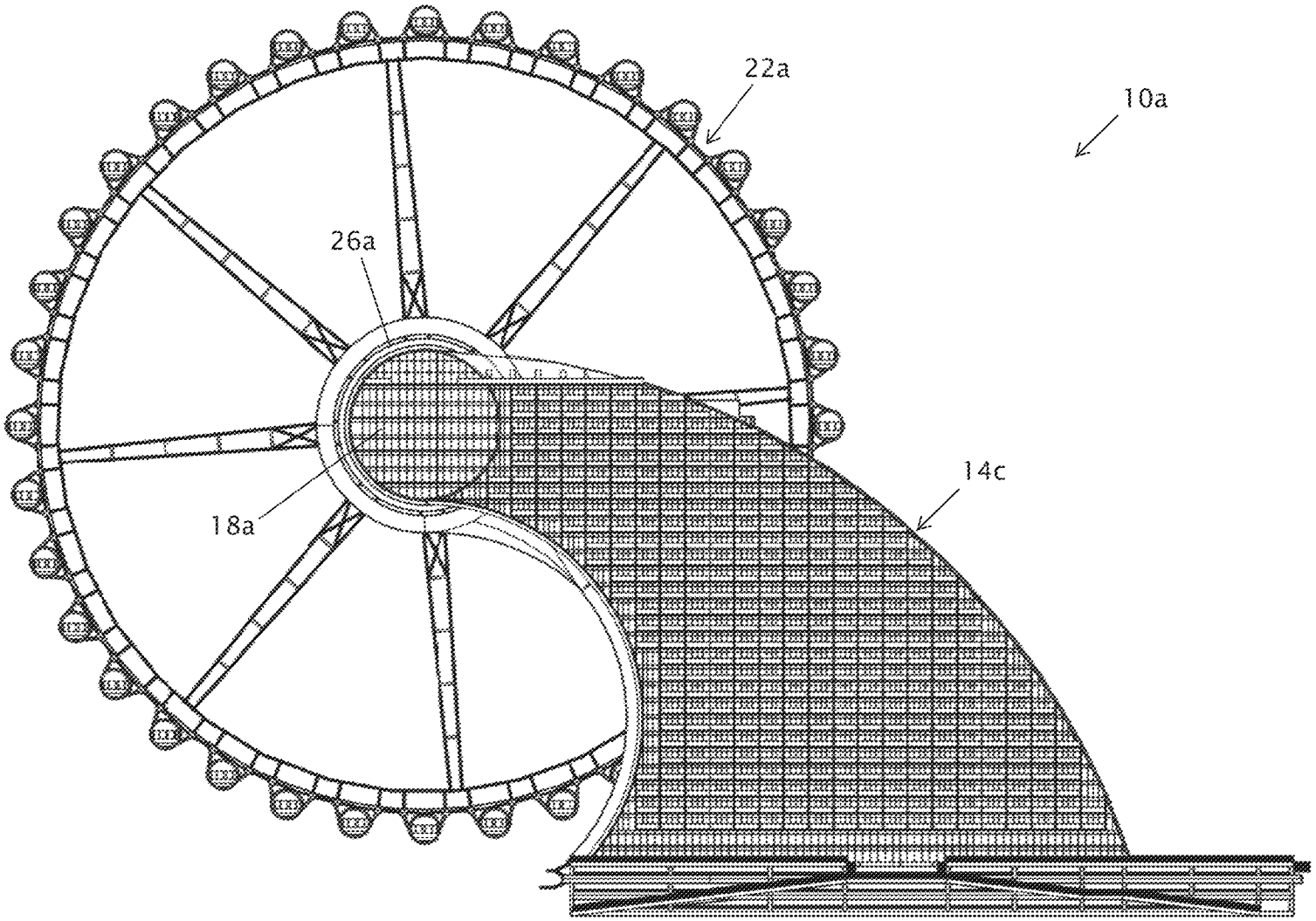
FIG. 9B is a side view of the system of FIG. 9A.
Figure 9C:
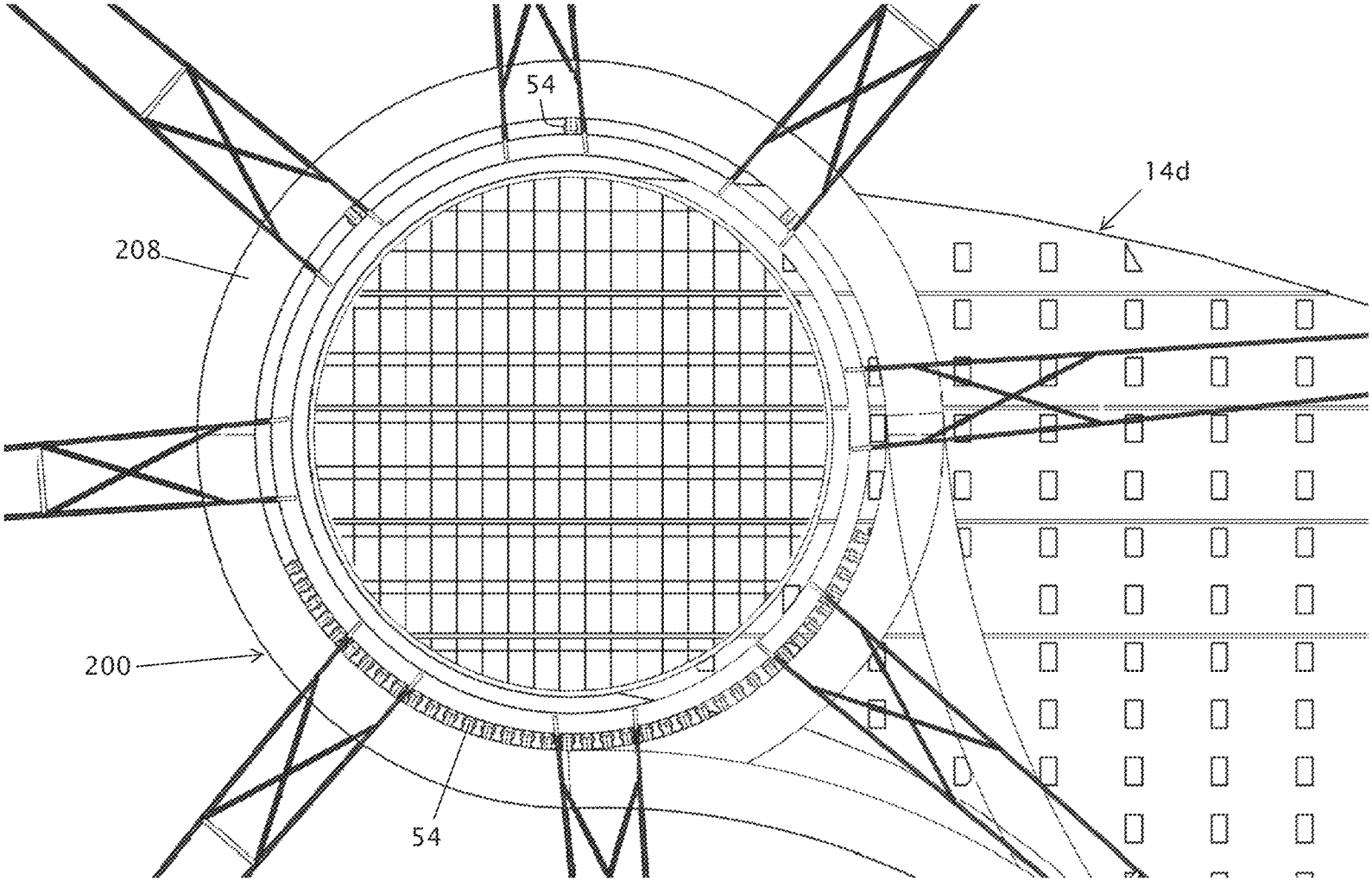
FIG. 9C is an enlarged side view of the tower hub portion of the system of FIG. 9A.
Figure 10A:
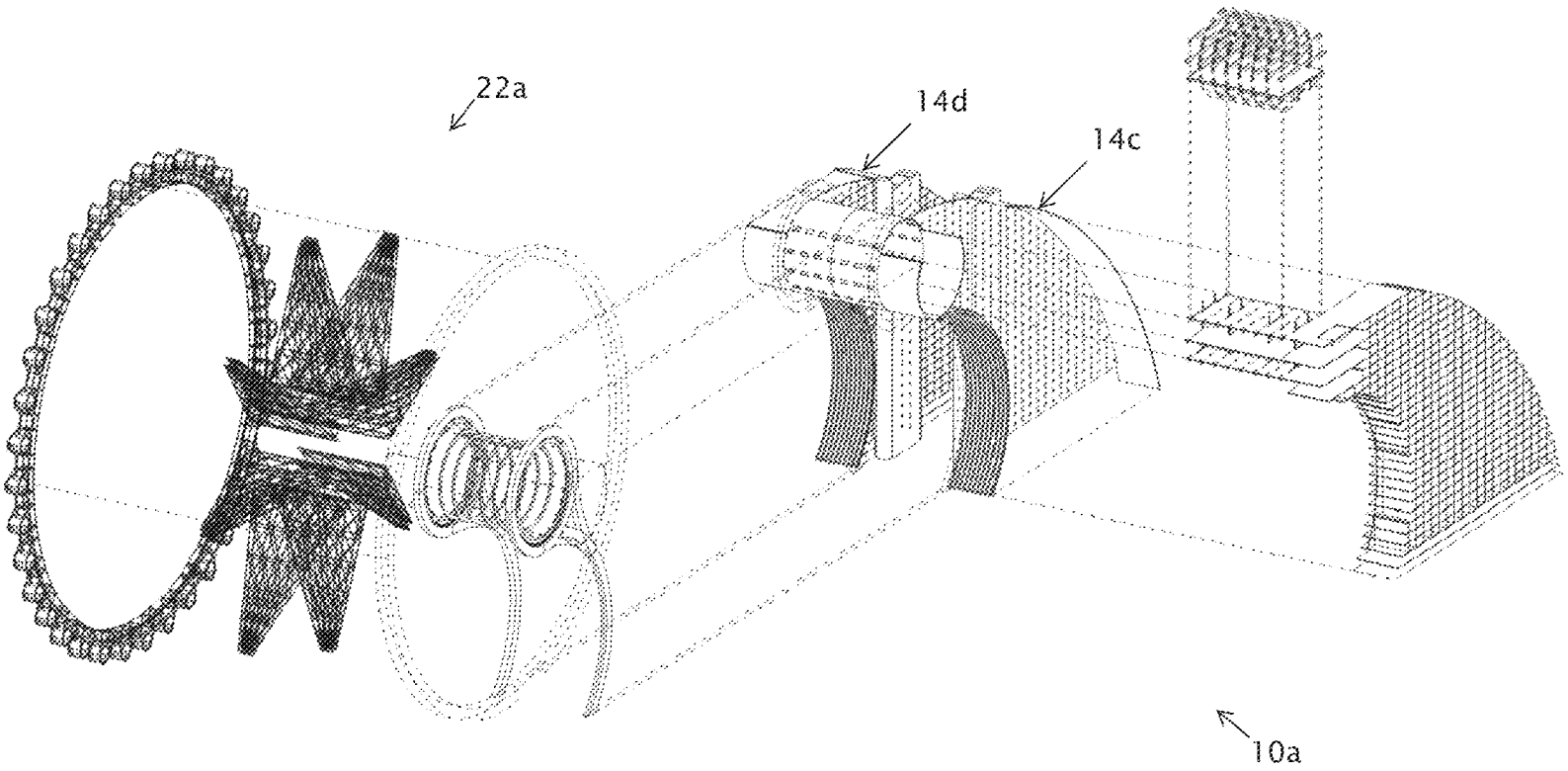
FIG. 10A is an exploded perspective view of the system of FIGS. 9A and 9B.
Figure 10B:
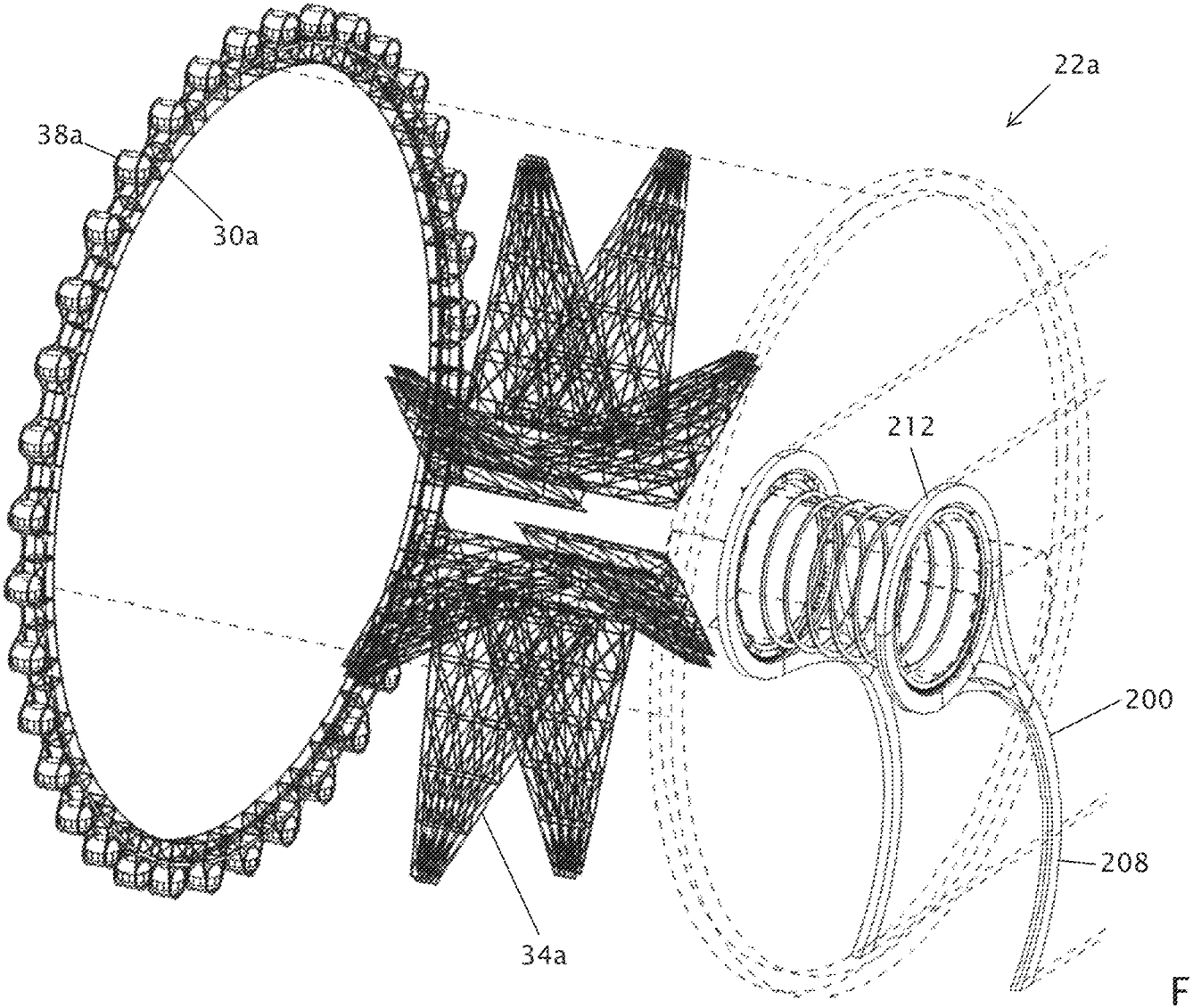
FIGS. 10B-10D are enlarged exploded perspective views of various portions of the system of FIGS. 9A and 9B.
Figure 10C:
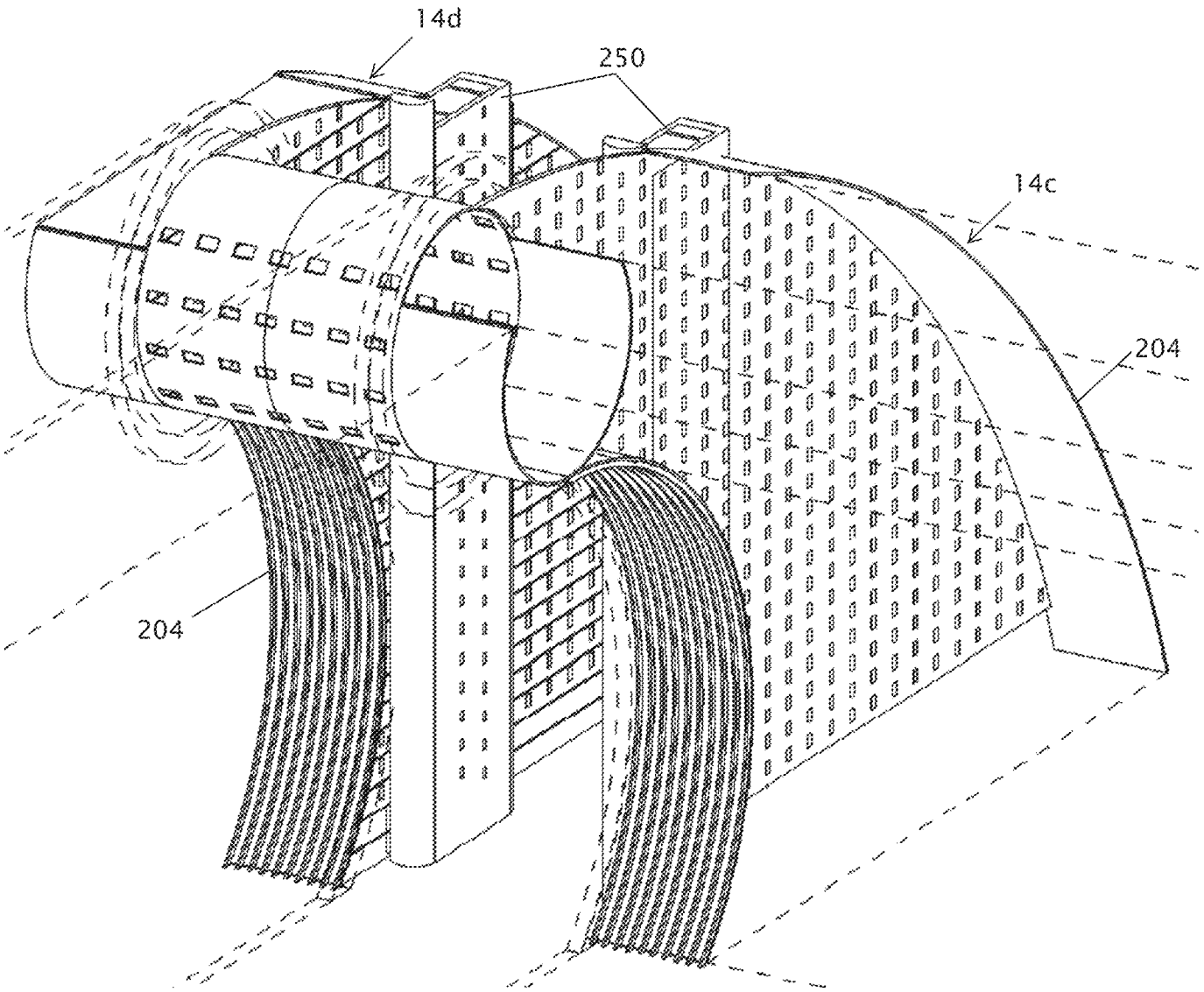
Figure 10D:
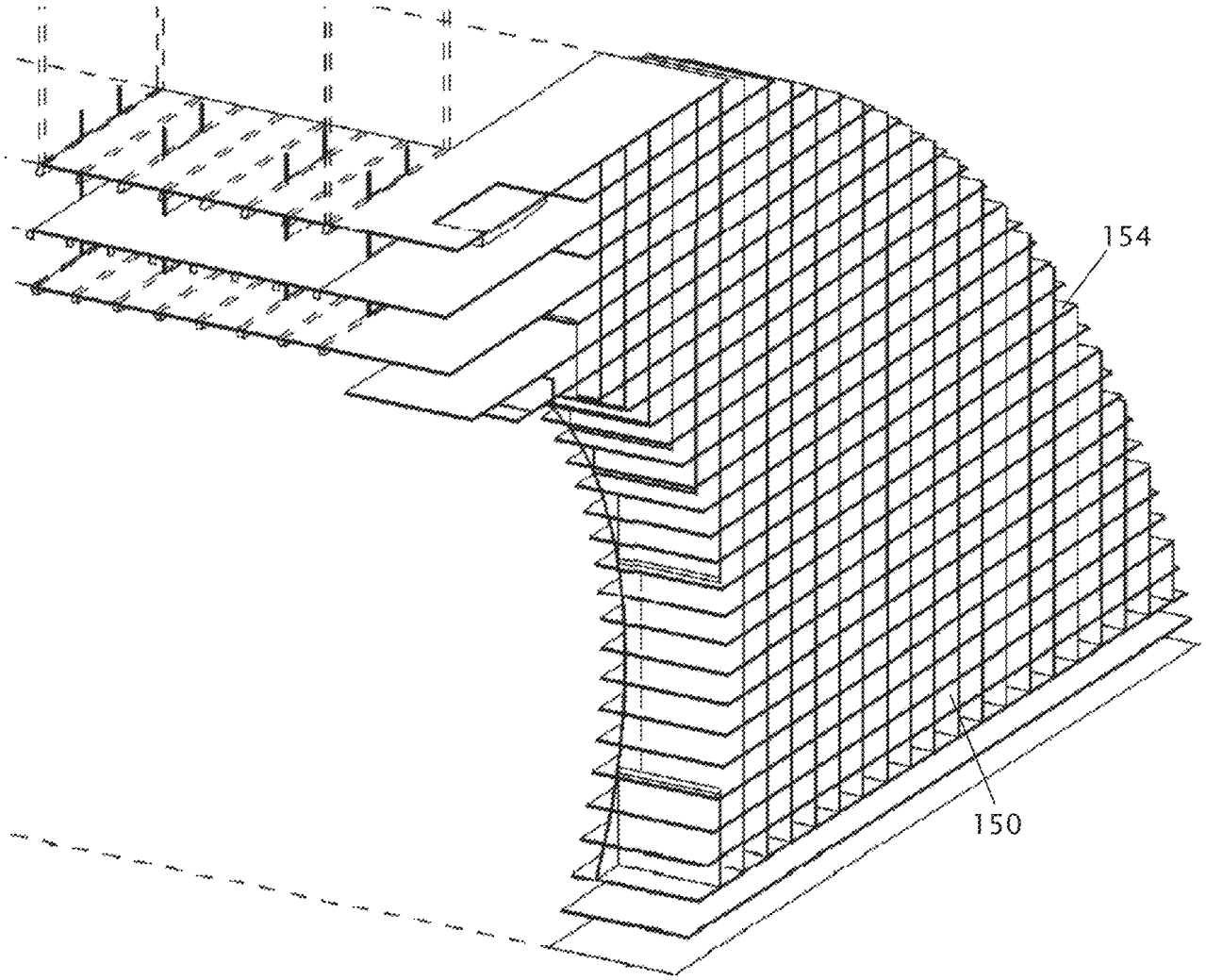
Figure 10E:
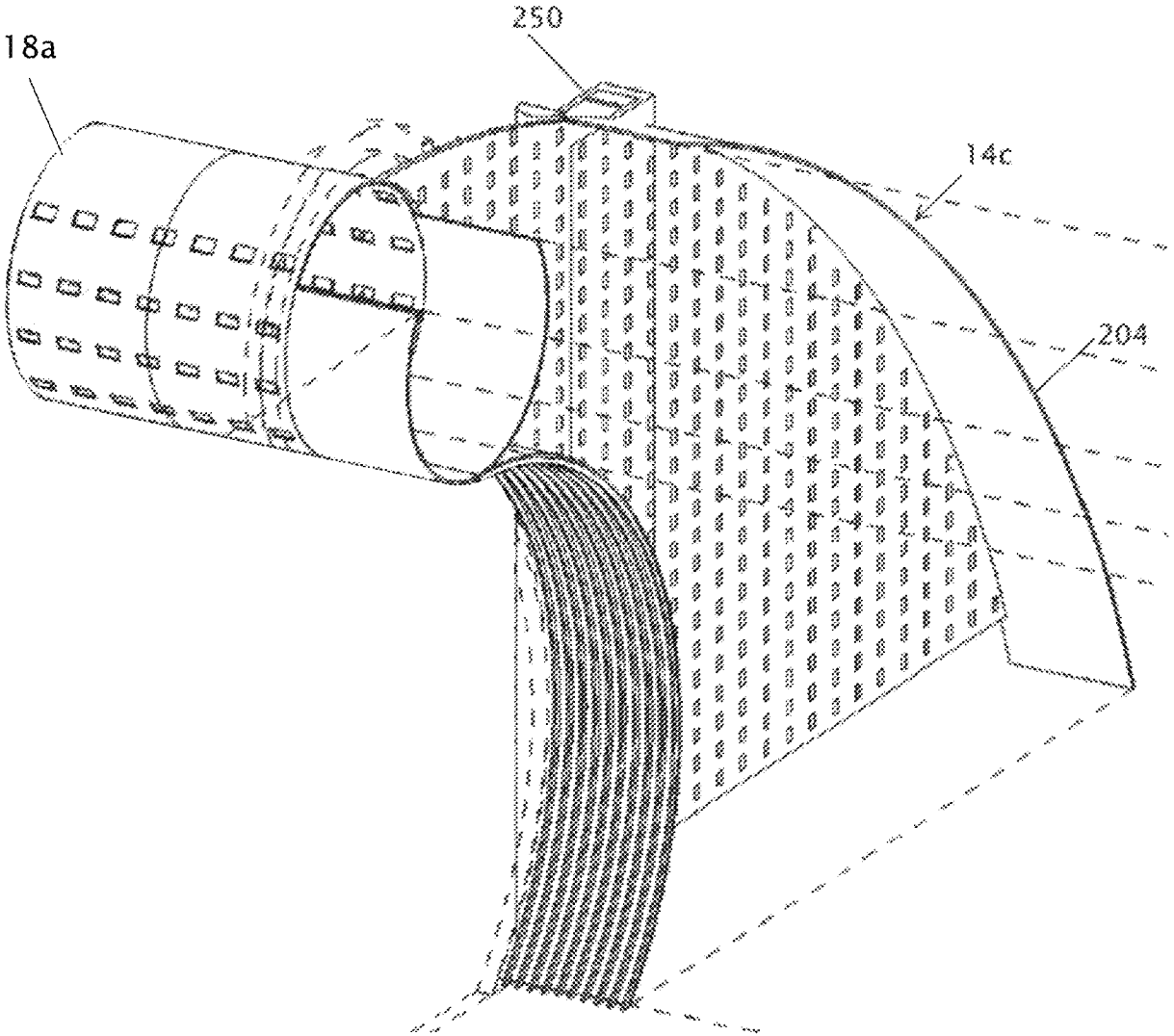
FIG. 10E is an enlarged exploded perspective view illustrating the tower and tower hub of a system that is substantially the same as the system of FIGS. 9A and 9B, the primary exception being that the tower hub in FIG. 10E is cantilevered from a single tower.
Figure 11:
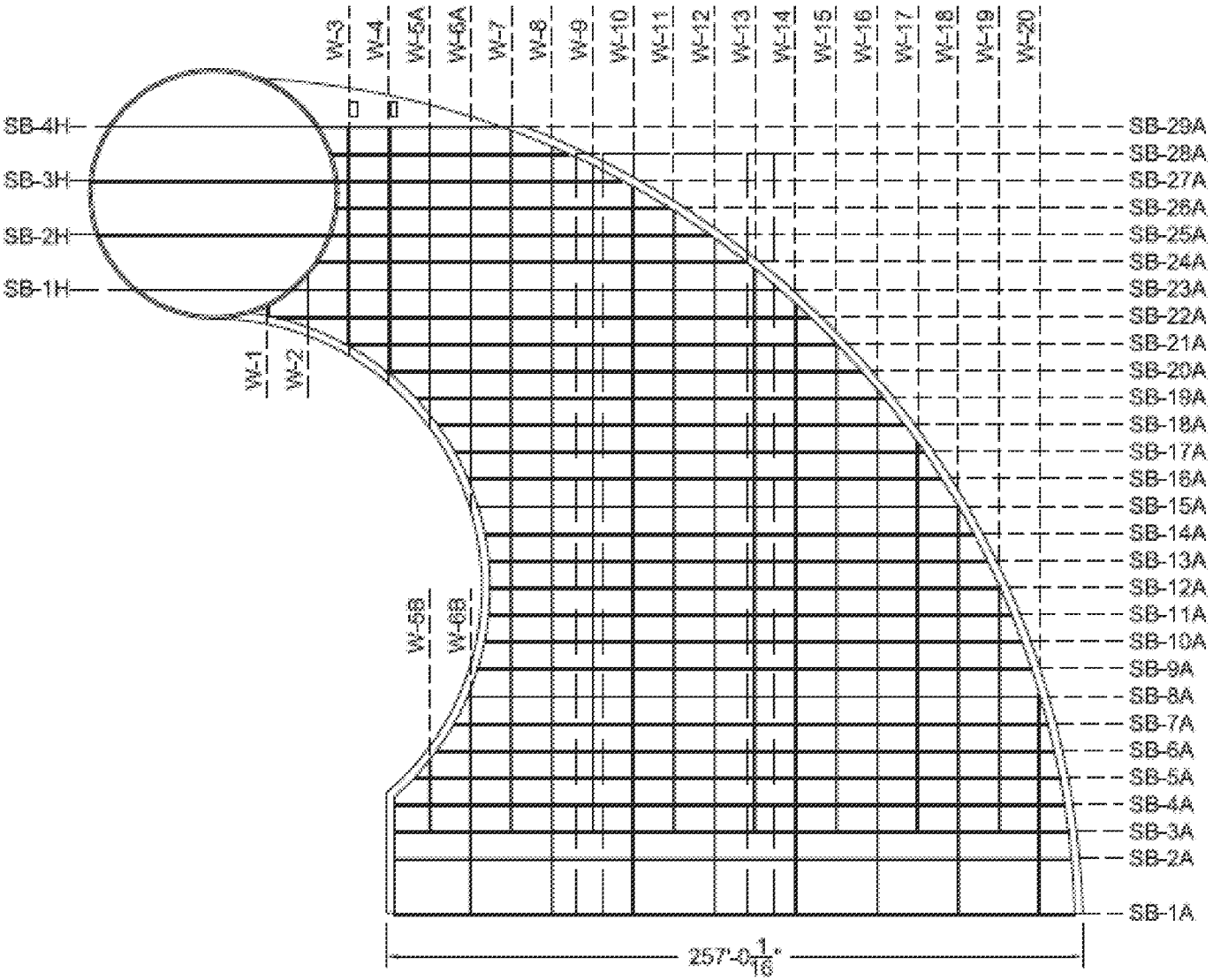
FIG. 11 is a schematic side view of the system of FIG. 9A showing the layout of floors and interior walls.
Figure 12:
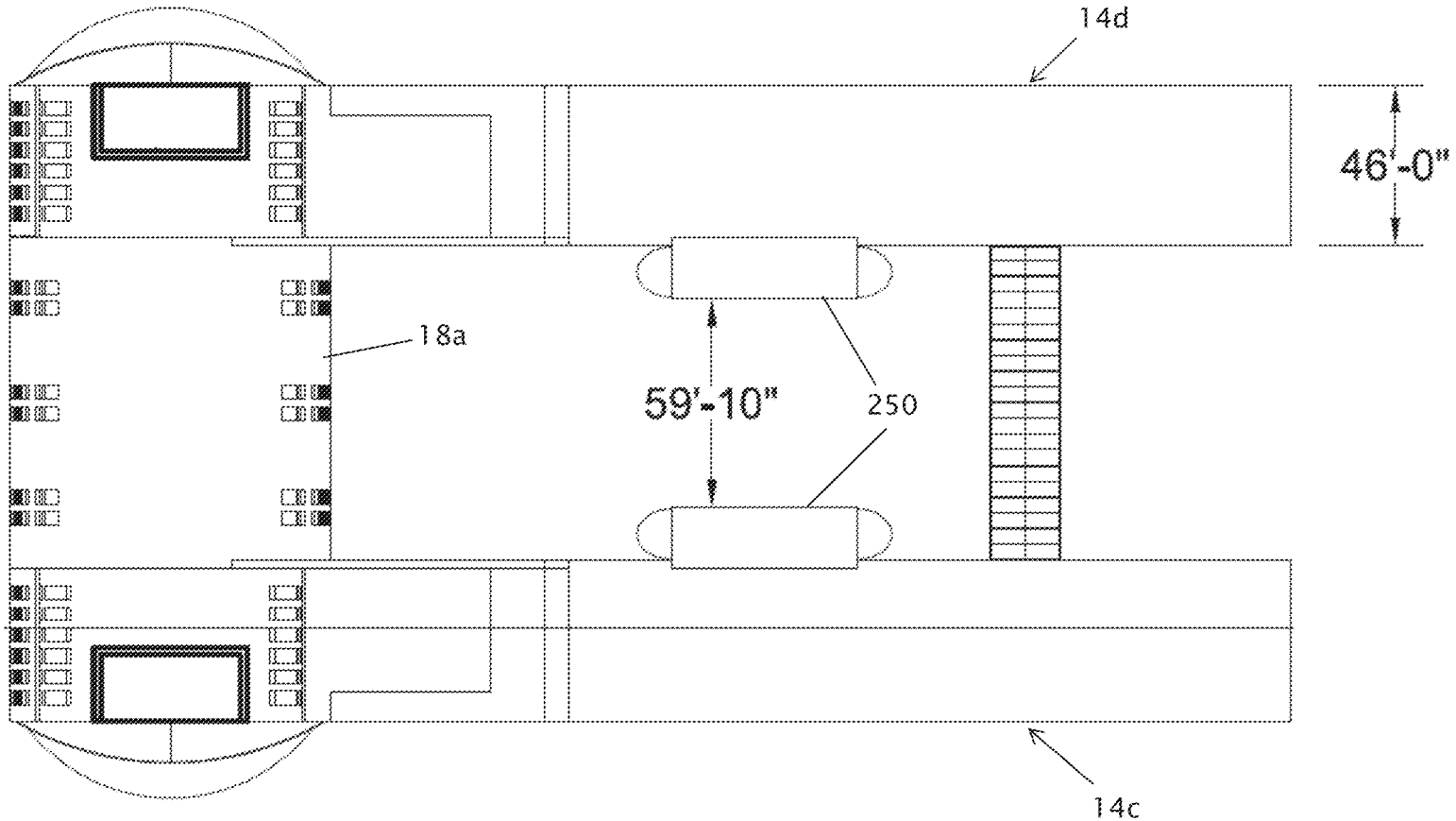
FIG. 12 is a top view of the system of FIG. 9A.
Figure 13:
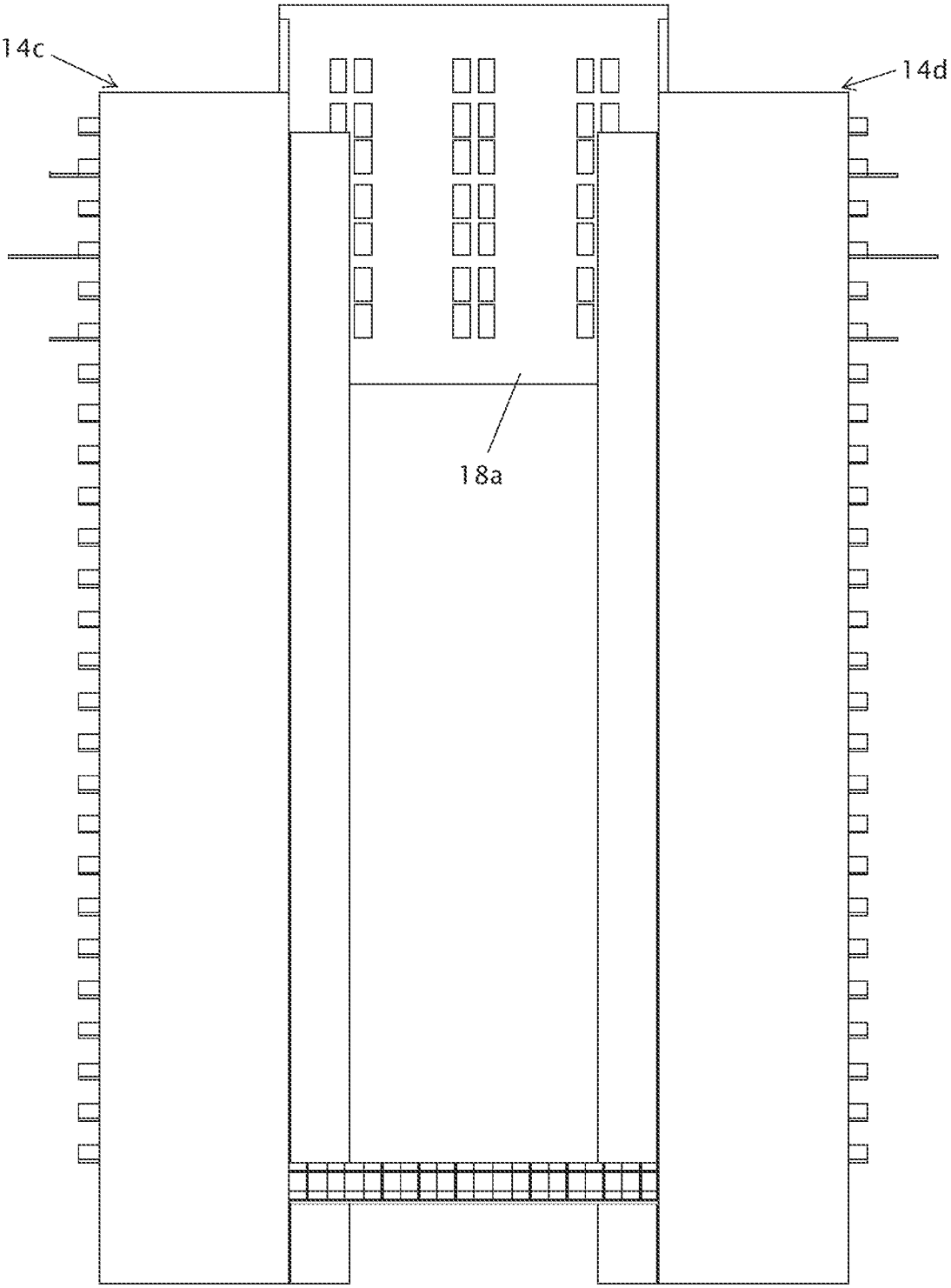
FIG. 13 is a rear view of the system of FIG. 9A.
Figure 14:
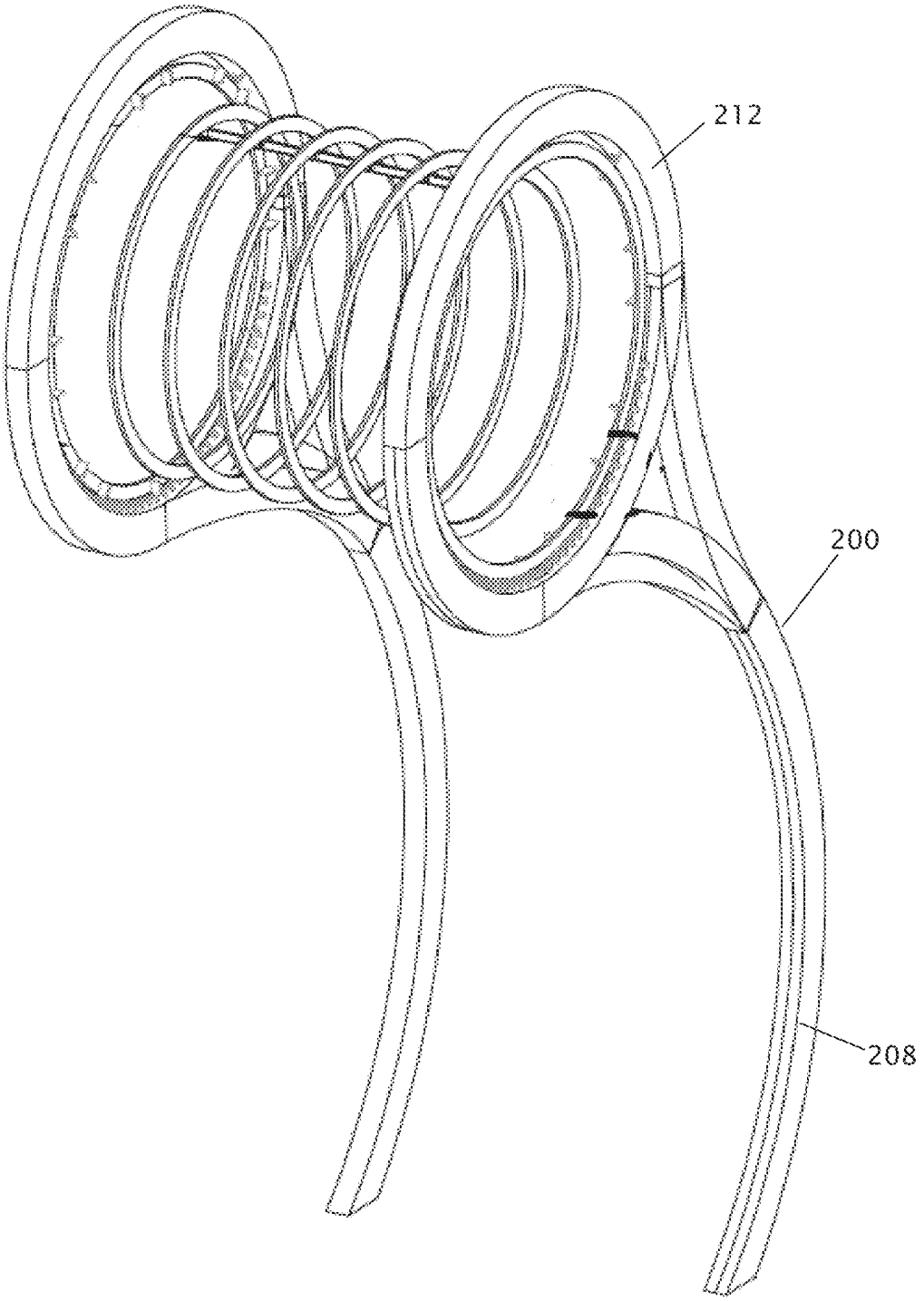
FIG. 14 is a perspective view of a suspension subsystem of the system of FIG. 9A.

Referring now to FIGS. 9A-14, a second embodiment 10*a* of the present systems is shown. More particularly, FIG. 9A is perspective view of system 10*a*; FIG. 9B is a side view of system 10*a*; FIG. 9C is an enlarged side view of a tower hub portion 18*a* of system 10*a*; FIG. 10A is an exploded perspective view of system 10*a*; FIGS. 10B-10D are enlarged exploded perspective views of various portions of system 10*a*; FIG. 11 is a schematic side view of system 10*a* showing the layout of floors and interior walls; FIG. 12 is a top view of system 10*a*; FIG. 13 is a rear view of system 10*a*; and FIG. 14 is a perspective view of a suspension subsystem of system 10*a*. System 10*a* is similar in some respects to system 10 such that similar reference numerals will be used to designate similar structures and the differences will primarily be described here.

In the embodiment shown, system 10*a* is an observation wheel system. In the embodiment shown, system 10*a* comprises a first tower 14*c* and a second tower 14*c*, a tower hub 18*a* coupled to and extending between first and second towers 14*c* and 14*d*. Tower hub 18*a* can, in some embodiments, have a transverse dimension of at least 50 feet (e.g., greater than 70 feet). For example, in the embodiment shown, tower hub 18*a* has a diameter of 80 feet. In the embodiment shown, system 10*a* also comprises an observation wheel 22*a* rotatably coupled to the towers and having a central wheel hub 26*a*. In the embodiment shown, observation wheel 22*a* comprises an outer ring 30*a* coupled to wheel hub 26*a* by a plurality of struts or spokes (and/or cables) 34*a*, and a plurality of gondolas 38*a* coupled to ring 30*a*. In the embodiment shown, ring 30*a* comprises dual ring members spaced apart and coupled together by a plurality of lateral members. Similarly, in the embodiment shown, wheel hub 26*a* comprises dual circular rail members (e.g., each having an I-shaped cross-sectional shape) that are spaced apart as illustrated. In the some embodiments, each of towers 14*c* and 14*c* has a base and a height of at least 200 feet above a ground level at each base, and observation wheel 22*a* has a transverse dimension of at least 400 feet (e.g., a diameter of 500 feet). In other embodiments, one of towers 14*c* and 14*d* may be partially or entirely omitted such that tower hub 18*a* is cantilevered from a single tower as shown in FIG. 10E. Towers 14*c* and 14*d* and/or tower hub 18*a* can, for example, comprise concrete and/or steel, and observation wheel 22*a* can comprise steel and/or any of various other high-strength metallic alloys.

In the embodiment shown, system 10*a* differs from system 10 in several ways. For example, in the depicted embodiment, towers 14*c* and 14*d* each defines a plurality of human-habitable spaces (e.g., hotel rooms, condominiums, office space, exhibit space, and/or parking garage space). For example, in some embodiments, the human-habitable space defined in each tower includes at least thirty percent (e.g., at least fifty percent) of the volume of the tower above ground level at a base of the tower. For example, in the embodiment shown, each tower includes a plurality of vertical walls 150 and a plurality of horizontal floors 154 defining habitable spaces within the tower. Each tower can comprise known construction elements, such as, for example, steel beams and/or pre-stressed and/or poured-in-place concrete beams and/or slabs.

In the embodiment shown, each tower 14*c* and 14*d* comprises: a suspension member 200 configured to support wheel hub 26*a*; and an enclosure 204 supporting tower hub 18*a*. In this embodiment, enclosure 204 is coupled to suspension member 200 such that the stiffness of the tower is greater than that of the suspension member alone. For example, the larger horizontal cross-section of enclosure 204 (relative to that of suspension member 200) may provide a greater resistance to twisting and bending moments, such that coupling the enclosure to the corresponding suspension member allows the enclosure to supplement the strength of the suspension member to increase stiffness. The mass of the enclosure and corresponding interior structure can also contribute to the stability of the respective tower (e.g., to resist forces due to wind pressure on the tower and the observation wheel).

In this embodiment, each suspension member 200 comprises a lower leg portion 208 and an upper ring portion 212 that is configured to encircle the wheel hub of the observation wheel, as shown. Suspension member 200 can comprise, for example, pre-stressed concrete and/or steel.

In some embodiments, system 10*a* also comprises one or more bearings (e.g., roller bearings) disposed between the tower hub and the wheel hub to rotatably support the observation wheel relative to the tower. For example, in the embodiment shown, the at least one bearing comprises a plurality of roller bearings 54 disposed between tower hub 18*a* and wheel hub 26*a* (e.g., supported by upper ring portion 212 of suspension member 200) to rotatably support the observation wheel relative to the tower. System 10*a* further differs relative to system 10 in that roller bearings 54 are spaced differently around the perimeter of wheel hub 26*a*. More particularly, in system 10*a*, a majority of bearings 54 are disposed around a lower half of wheel hub 26*a* (e.g., within an 170-degree, 160-degree, or smaller arc centered that is centered and a vertical, radial axis of the wheel hub). For example, in the depicted embodiment, thirty seven roller bearings 54 are disposed at equiangular intervals along an arc of the lower half of ring portion 212 of suspension member 200, and three roller bearings 54 are disposed at equiangular intervals along an arc of the upper half of ring portion 212 of suspension member. In this configuration, the lower group of roller bearings support the full weight of the observation wheel, and the upper group of roller bearings maintain the position of the observation wheel and act as retainers prevent the observation wheel from lifting off of the lower group of roller bearings. In this embodiment, first end 62 of each bearing mount 58 is coupled to ring portion 212 of the respective suspension member 200. In other embodiments, ring bearings 54 may be disposed at equiangular intervals around the entire circumference of ring portion 212. Otherwise, the respective sizes (and ratios therebetween) of bearing assemblies 50, tower hub 18*a*, and/or wheel hub 26*a* can be similar to the corresponding structures of system 10.

In the embodiment shown, system 10*a* also differs relative to system 10 in that struts or spokes (and/or cables) 34*a* of observation wheel 22*a* are arranged in a plurality of (e.g., eight) distinct groups with interconnecting trusses, as shown.

In the embodiment shown, system 10*a* also differs relative to system 10 in that system 10*a* includes elevator towers 250 that are laterally offset relative to the rotational axis of the observation wheel, and that are coupled to an interior wall of enclosure 204, as shown, rather than being internal to a planar wall that also defines the rest of the tower (FIG. 12). In some embodiments, elevator towers 250 may be similar to towers 14*a* and 14*b*.

Some embodiments of the present methods (e.g., of making a system such as system 10*a*) can comprise erecting a tower (e.g., 14*c*, 14*d*) defining a plurality of human-habitable spaces; coupling a tower hub (e.g., tower hub 18*a* having a transverse dimension of at least 50 feet) to the tower; where the tower and/or tower hub are configured to support an observation wheel (e.g., 18*a*) having a central wheel hub and rotatable coupled to the tower via one or more bearings disposed between the tower hub and the wheel hub.

Figure 15:
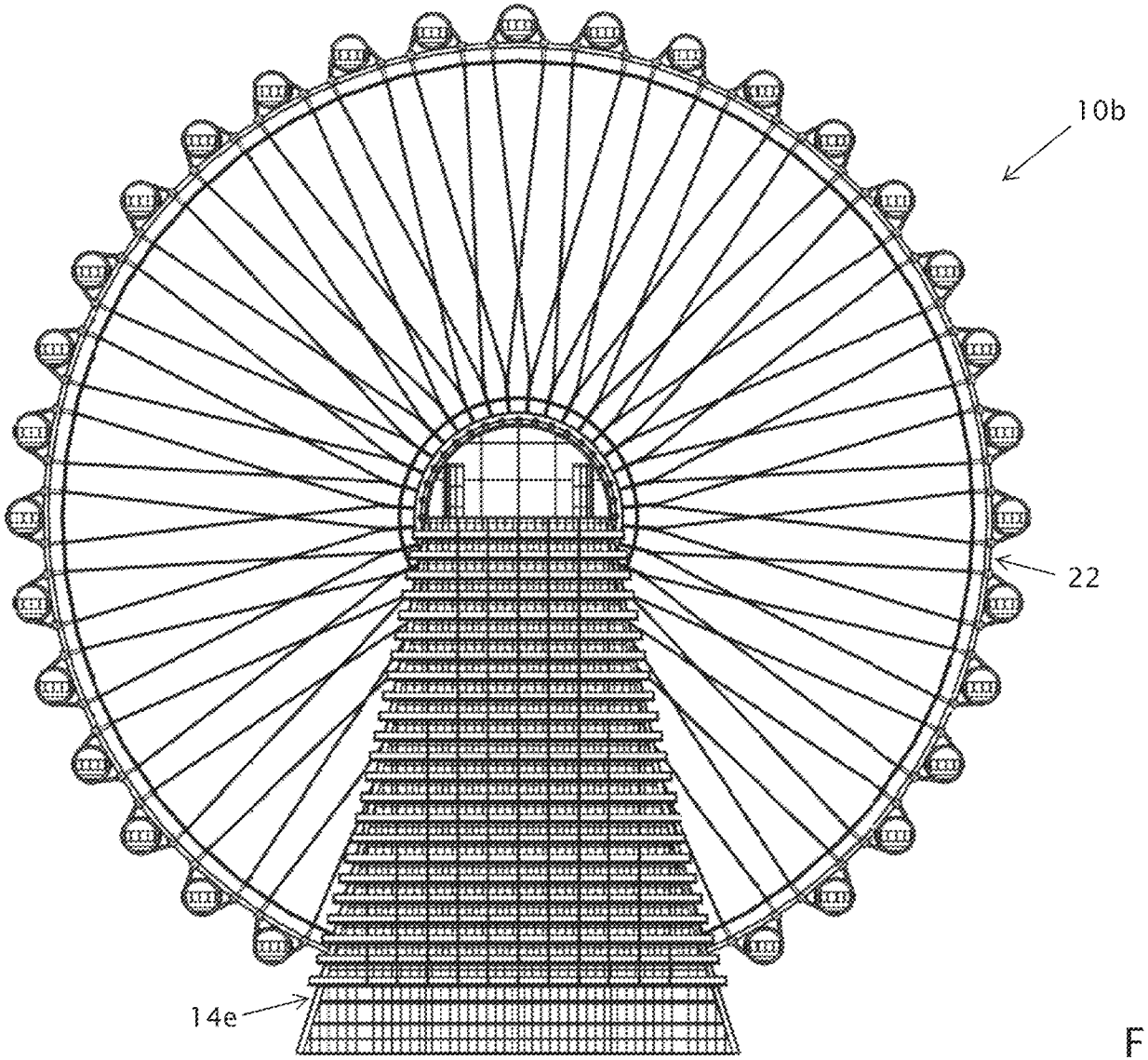
FIG. 15 is a side view of a third embodiment of the present systems.
Figure 16:
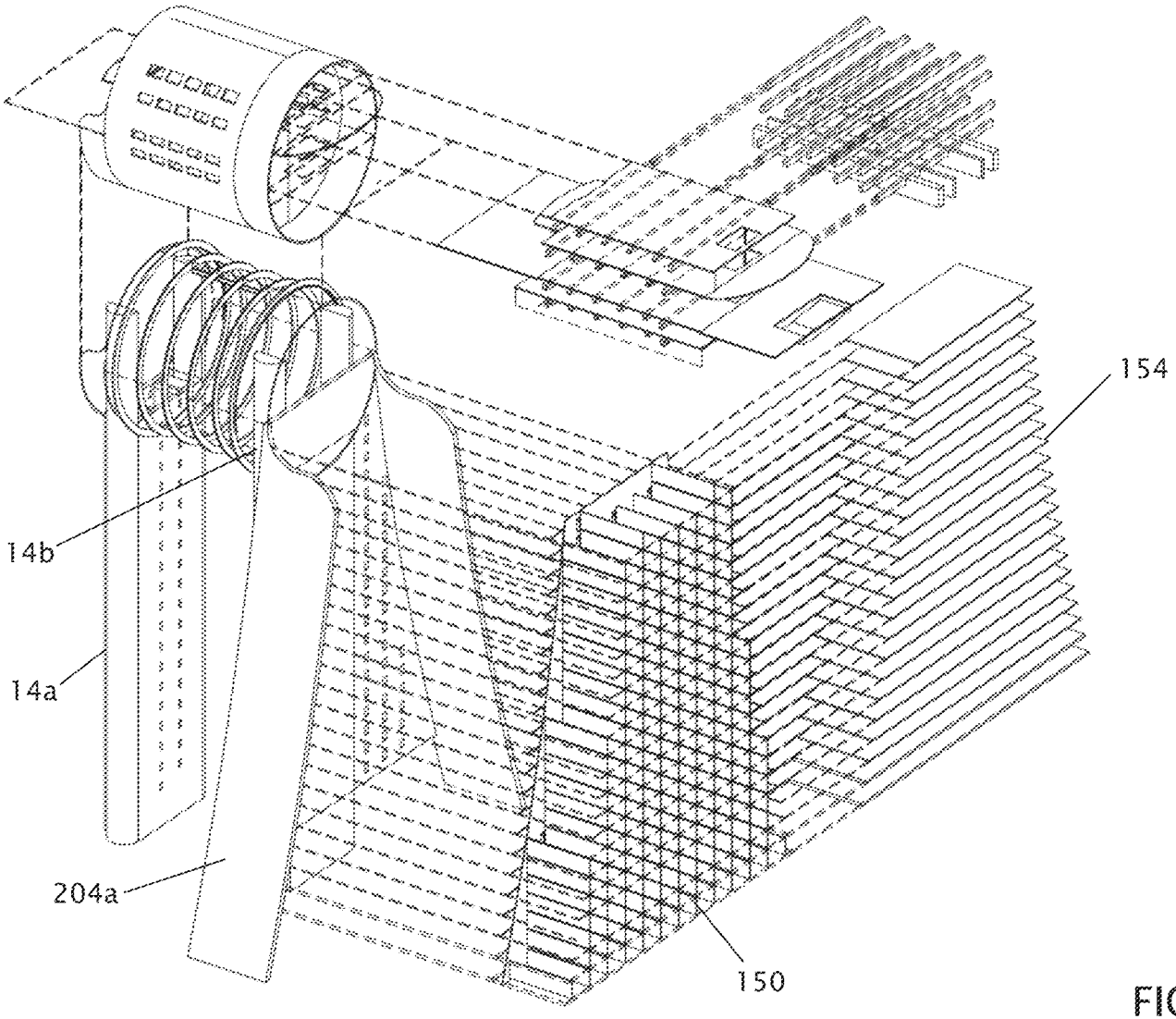
FIG. 16 is an exploded perspective view of the system of FIG. 15.

FIGS. 15 and 16 depict a third embodiment 10*b* of the present systems. More particularly, FIG. 15 is a side view of system 10*b*, and FIG. 16 is an exploded perspective view of a portion of system 10*b*. System 10*b* is largely similar to system 10 in the inclusion of tower 14*a*, observation wheel 22, and tower hub 18. System 10*b* is also similar to system 10*a* in the inclusion of a tower 14*e* that defines human habitable space. In this embodiment, tower 14*e* comprises a suspension member 200*a* (similar to tower 14*b*) and enclosure 204*a* within which a plurality of vertical walls 150*a* and a plurality of horizontal floors 154*a* defining habitable spaces within the tower.

Figure 17:
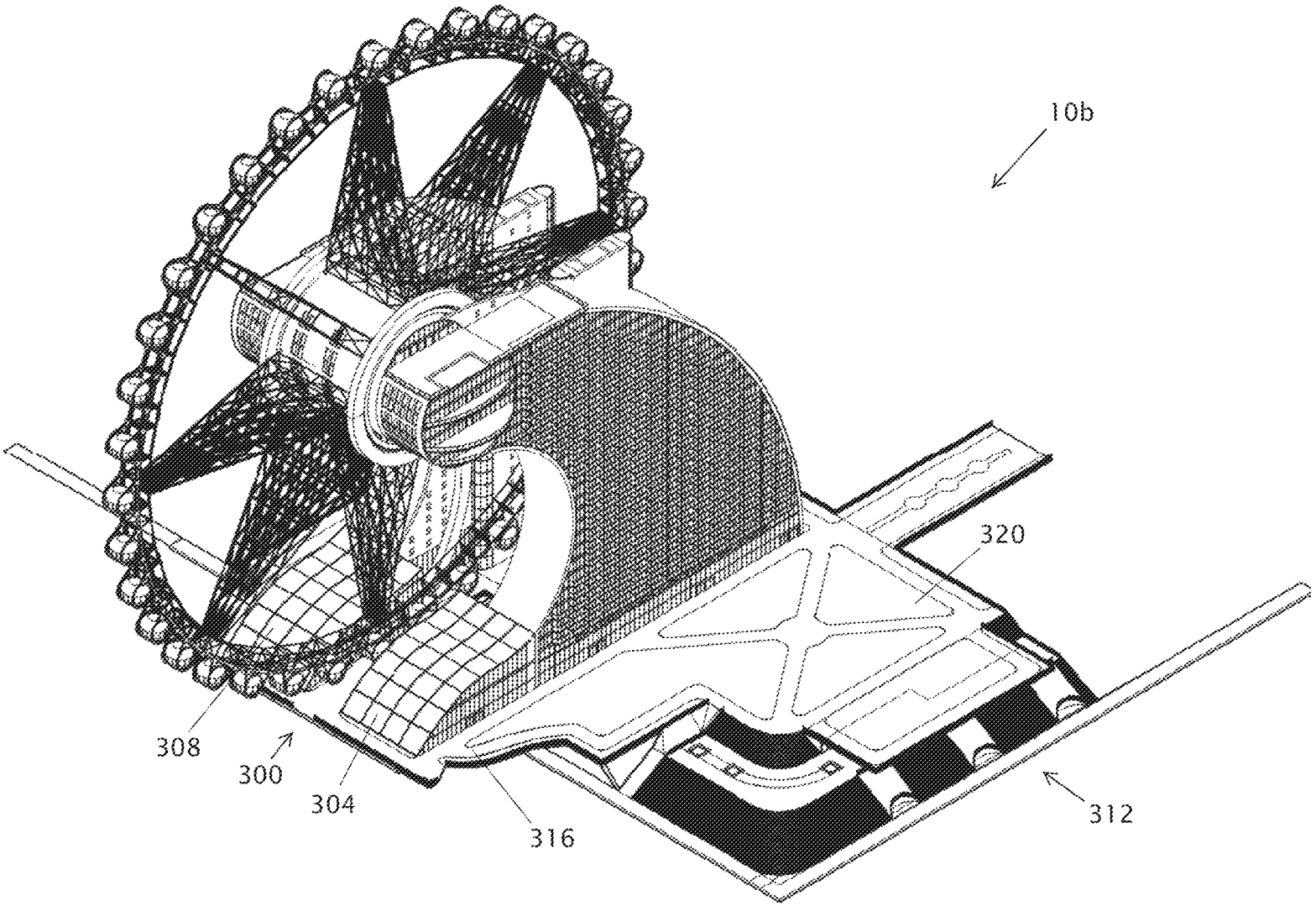
FIG. 17 is a perspective view of a fourth embodiment of the present systems.

FIG. 17 depicts a perspective view of a fourth embodiment 10*c* of the present systems. System 10*c* is largely similar to system 10*a* in the inclusion of towers 14*c* and 14*d*, observation wheel 22*a*, and tower hub 18*a*. In the embodiment shown, system 10*c* further comprises a loading structure (e.g., pavilion) 300 comprising an enclosure adjacent to one or more of the gondolas 38*a* (e.g., when in the lowermost position) such that at least one of the gondolas can be accessed (e.g., loaded or unloaded) from the loading structure. In other embodiments, the loading structure may be only partially enclosed (e.g., a canopy with no walls or walls on fewer than all sides), or may be partially or whole open (not covered). In this embodiment, loading structure 300 includes a first portion 304 on a first side of observation wheel 22*a*, and a second portion 308 on a second side of observation wheel 22*a*. In this embodiment, for example, one of first and second portions 304 and 308 can be used as a loading area, and the other of first and second portions 304 and 308 can be used a unloading area. In the embodiment shown, system 10*c* includes a parking structure 312 at the base of towers 14*b* and 14*c*, and a portion 316 of an upper deck 320 (or roof) of the parking structure extends (e.g. is cantilevered) outward relative to other parts of parking structure 312. In this embodiment, portion 316 provides a support or base for loading pavilion 300 as shown. In other embodiments, loading pavilion 300 may extend upward from the ground rather than being supported by a cantilevered portion of the parking structure (or towers).

The above specification and examples provide a complete description of the structure and use of illustrative embodiments. Although certain embodiments have been described above with a certain degree of particularity, or with reference to one or more individual embodiments, those skilled in the art could make numerous alterations to the disclosed embodiments without departing from the scope of this invention. As such, the various illustrative embodiments of the methods and systems are not intended to be limited to the particular forms disclosed. Rather, they include all modifications and alternatives falling within the scope of the claims, and embodiments other than the one shown may include some or all of the features of the depicted embodiment. For example, elements may be omitted or combined as a unitary structure, and/or connections may be substituted. Further, where appropriate, aspects of any of the examples described above may be combined with aspects of any of the other examples described to form further examples having comparable or different properties and/or functions, and addressing the same or different problems. Similarly, it will be understood that the benefits and advantages described above may relate to one embodiment or may relate to several embodiments.

The claims are not intended to include, and should not be interpreted to include, means-plus- or step-plus-function limitations, unless such a limitation is explicitly recited in a given claim using the phrase(s) "means for" or "step for," respectively.

The invention claimed is:

1. A system comprising:

a tower hub that has a transverse dimension of at least 50 feet and is cantilevered from a single tower, the single tower comprising:

an enclosure defining an interior volume; and a plurality of vertical walls and a plurality of horizontal floors disposed within the interior volume;

wherein the walls and floors are coupled in fixed relation to the enclosure such that the walls and floors define a plurality of human-habitable spaces within the interior volume;

a loading structure defining a loading surface at a height that is lower than a height of the tower hub; and an observation wheel having a central wheel hub and one or more gondolas, the observation wheel rotatably coupled to the single tower such that the central wheel hub is configured to rotate around the tower hub and at least one of the gondola(s) is accessible from the loading surface.

2. The system of claim 1, wherein:

the single tower includes a base and has a height that is at least 200 feet; and the observation wheel has a transverse dimension that is at least 400 feet.

3. The system of claim 1, wherein:

the single tower comprises a suspension member having a leg portion and a ring portion, wherein the ring portion is disposed around the central wheel hub and the leg portion extends between the ring portion and a ground surface; and a plurality of bearing assemblies are disposed between the ring portion and the central wheel hub to rotatably support the observation wheel relative to the single tower, wherein each of the bearing assemblies comprises a roller bearing rotatably coupled to a bearing mount, the roller bearing having a diameter that is less than one quarter of a transverse dimension of the central wheel hub.

4. The system of claim 1, comprising a plurality of roller bearings disposed between the tower hub and the central wheel hub to rotatably support the observation wheel relative to the single tower, the roller bearings each having a diameter that is less than one quarter of a transverse dimension of the central wheel hub.

5. The system of claim 4, comprising a plurality of bearing mounts, each coupled to a respective one of the roller bearings.

6. The system of claim 5, wherein each of the bearing mounts has a first end coupled in fixed relation to the tower hub and a second end rotatably coupled to a respective one of the roller bearings.

7. The system of claim 4, where each of the roller bearings is independently sealed.

8. The system of claim 1, where the human-habitable spaces have a combined volume that is at least thirty percent of the interior volume of the single tower.

9. The system of claim 8, where the human-habitable spaces have a combined volume that is at least fifty percent of the interior volume of the single tower.

10. The system of claim 1, wherein:

a base of the single tower is disposed on the loading surface defined by the loading structure.

11. The system of claim 1, wherein the tower hub has:

a shell defining an interior space that is accessible from the single tower; and one or more horizontal floors coupled to the shell such that at least a portion of each of the floor(s) of the shell is disposed within the interior space.

12. The system of claim 3, wherein:

the ring portion has an interior circumference that comprises an upper semicircular arc and a lower semicircular arc;

a first set of the bearing assemblies is coupled to the upper semicircular arc; and a second set of the bearing assemblies is coupled to the lower semicircular arc, the second set comprising a majority of the bearing assemblies.

13. The system of claim 1, comprising one or more motors configured to rotate the observation wheel, each of the motor(s) fixed to the central wheel hub or the tower hub.

14. The system of claim 1, wherein the loading structure comprising a parking structure.

15. The system of claim 13, wherein each of the motor(s) is fixed to the tower hub.

16. A system comprising:

a tower hub that has a transverse dimension that is at least 50 feet and is cantilevered from a single tower;

an observation wheel having a central wheel hub and rotatably coupled to the single tower such that the central wheel hub is configured to rotate around the tower hub; and one or more motors configured to rotate the observation wheel, each of the motor(s) fixed to the central wheel hub or the tower hub.

17. The system of claim 16, wherein the tower hub has:

a shell defining an interior space that is accessible from the single tower; and one or more horizontal floors coupled to the shell such that at least a portion of each of the floor(s) of the shell is disposed within the interior space.

18. The system of claim 16, comprising a plurality of roller bearings disposed between the tower hub and the central wheel hub to rotatably support the observation wheel relative to the single tower, the roller bearings each having a diameter that is less than one quarter of a transverse dimension of the central wheel hub.

19. The system of claim 16, wherein:

a height of the single tower is at least 200 feet; and the observation wheel has a transverse dimension that is at least 400 feet.

20. The system of claim 16, wherein each of the motor(s) is fixed to the tower hub.

* * * * *